US005135835A

United States Patent [19]

Aono et al.

[11] Patent Number: 5,135,835

[45] Date of Patent: * Aug. 4, 1992

[54] HEAT DEVELOPMENT USING DYE FIXING MATERIALS WITH OIL DROPLETS AND/OR POLYMERIC LATEXES

[75] Inventors: Toshiaki Aono; Takeshi Shibata; Tsumoru Hirano, all of Kanagawa, Japan

[73] Assignee: Fuji Photo Film Co., Ltd., Kanagawa, Japan

[ * ] Notice: The portion of the term of this patent subsequent to Apr. 26, 2005 has been disclaimed.

[21] Appl. No.: 754,200

[22] Filed: Aug. 28, 1991

Related U.S. Application Data

[63] Continuation of Ser. No. 39,546, Apr. 17, 1987, abandoned.

[30] Foreign Application Priority Data

Apr. 18, 1986 [JP] Japan ..... 61-88258
Apr. 18, 1986 [JP] Japan ..... 61-88259
Apr. 18, 1986 [JP] Japan ..... 61-89508

[51] Int. Cl.[5] ..... G03C 5/54

[52] U.S. Cl. ..... 430/203; 430/213; 430/215; 430/631

[58] Field of Search ..... 430/203, 215, 213, 631, 430/212

[56] References Cited

U.S. PATENT DOCUMENTS

| | | | |
|---|---|---|---|
| 4,536,466 | 8/1985 | Sakaguchi et al. | 430/203 |
| 4,599,296 | 7/1986 | Sakaguchi et al. | 430/203 |
| 4,665,005 | 5/1987 | Aono et al. | 430/203 |
| 4,693,954 | 9/1987 | Naito | 430/203 |
| 4,696,887 | 9/1987 | Sato et al. | 430/203 |
| 4,704,344 | 11/1987 | Aono et al. | 430/203 |
| 4,740,445 | 4/1988 | Hirai et al. | 430/203 |

OTHER PUBLICATIONS

"Photographic Applications of Latices" *Research Disclosure* No. 19551, Jul. 1980, pp. 301-310.

*Primary Examiner*—Richard L. Schilling
*Attorney, Agent, or Firm*—Sughrue, Mion, Zinn, Macpeak & Seas

[57] ABSTRACT

A method for forming an image comprising heating, in the presence of water and at least one of a base and a base precursor, a combination of (i) a light-sensitive element comprising a support provided thereon at least a light-sensitive silver halide, a binder, and a dye providing substance and (ii) a dye fixing element comprising a mordant capable of fixing a mobile dye formed in said light-sensitive element, wherein said dye fixing element further contains at least one of oil droplets and a latex comprising a polymer having a glass transition point of 40° C. or less.

52 Claims, No Drawings

HEAT DEVELOPMENT USING DYE FIXING MATERIALS WITH OIL DROPLETS AND/OR POLYMERIC LATEXES

This is a continuation of application Ser. No. 07/039,546 filed Apr. 17, 1987, now abandoned.

BACKGROUND OF THE INVENTION

The present invention relates to a method for forming dye images by heating, and more particularly to a method for forming excellent dye images on a dye fixing element.

A heat developable light-sensitive material is known in the field of photographic technology. Such heat developable light-sensitive materials and processes therefor are described, for example, in *Shashin Kogaku no Kiso* (Fundamentals of Photographic Technique), Volume of non-silver salt photography, Corona Co., Ltd., pp. 242 to 255 (1982); *Eizo Joho* (Image Information), April 1978, page 40, *Neblette's Handbook of Photography and Reprography,* 7th Ed., Van Nostrand Reinhold Company, pp. 32 to 33, U.S. Pat. Nos. 3,152,904, 3,301,678, 3,392,020, 3,457,075, British Patents 1,131,108, 1,167,777 and *Research Disclosure,* June 1978, pp. 9 to 15 (RD-17029).

Many methods have been proposed to form color images by heat development. In connection with a method for forming color image by bonding together an oxidized developing agent and a coupler, a p-phenylenedimaine series reducing agent and a phenol or active methylene coupler are disclosed in U.S. Pat. No. 3,531,286; a p-aminophenol series reducing agent, in U.S. Pat. No. 3,761,270; a sulfonamidophenol series reducing agent, in Belgian Patent 802,519 and *Research Disclosure,* Sep. 31, 1975, page 32; and a combination of a sulfonamidophenol-based reducing agent and a 4-equivalent coupler, in U.S. Pat. No. 4,021,240.

The above methods, however, have disadvantages in that since an image of reduced silver and a color image are formed at the same time in imagewise exposed areas after heat development, the color image tends to become turbid.

In order to overcome the above disadvantages, a method for removing silver images by liquid treatment and a method for transferring the dye alone to a sheet having, for example, an image receiving layer have been proposed. These methods, however, also have disadvantages in that it is not easy to separate the unreacted products and the dye, and to transfer only the dye.

In addition, the above methods have disadvantages in which a relatively long time is generally needed for development, and there is obtained only images of relatively high fog and low density.

In order to overcome the above problems, a method comprising releasing imagewise a mobile dye by heating and transferring the mobile dye to a dye fixing element containing a mordant by the use of a solvent such as water, a method comprising transferring the mobile dye to a dye fixing element by the use of a high boiling point organic solvent, a method comprising transferring the mobile dye to a dye fixing element by the use of a hydrophilic heat solvent contained in the dye fixing element, and a method in which the mobile dye is heat diffusible or sublimable and is transferred to a dye receiving element such as a support have been proposed (described e.g., in U.S. Pat. Nos. 4,463,079 4,474,867, 4,478,927, 4,507,380, 4,500,626, 4,483,914, Japanese Patent Application (OPI) Nos. 149046/83, 149047/83, 152440/84, 154445/84, 165054/84, 180548/84, 168439/84, 174832/84, 174833/84, 174834/84 and 174835/84 (the term "OPI" as used herein means a "published unexamined Japanese patent application")).

In accordance with the above methods, however, the development temperature required is still high and the processing time for obtaining dye images is not sufficiently short.

Under such circumstances, Japanese Patent Application (OPI) Nos. 218443/84 and 238056/86 have disclosed a method in which heat development is carried out in the presence of a small amount of water and a base and/or a base precursor and further a released dye is transferred, whereby acceleration of development, decreasing the developing temperature, simplifying the processing, and shortening the processing time can be realized.

In the above image forming method, a dye fixing element containing a mordant is used to fix a mobile dye.

These mordants are usually coated on a support or on other coatings by using a hydrophilic colloid such as gelatin as a binder. However, a coating containing such polymeric mordant(s) and hydrophilic colloid(s) has dynamic properties markedly different from those of a coating containing the hydrophilic colloid alone. That is, it has been found that the coating containing both the polymeric mordant and hydrophilic colloid such as gelatin is seriously decreased in tensile strength and breaking elongation as compared with a coating is brittle. Such an increase in brittleness of the coating is responsible for cracking due to thermal and dynamic strains occurring at the coating step or drying step of the coating, and imposes serious limitations on production conditions such as coating and drying.

It has also been found that the mordant layer of the dye fixing element tends to break or crack when thermal and dynamic strains are applied during the handling of the dye fixing element.

If such cracked dye fixing elements are used in the above image forming methods, unevenness is formed in development and/or in dye transfer, and a formed image appears as gaps are formed therein, and thus the image quality is seriously deteriorated.

SUMMARY OF THE INVENTION

An object of the present invention is to provide a method for forming a dye image by heat developing in the presence of a small amount of water, which method is free from the problems of uneven transfer and deterioration of image quality due to cracking.

The above and other objects of the present invention are attained by a method for forming an image which comprises heating, in the presence of water and at least one of a base and a base precursor (also referred to as "a base and/or a base precursor" hereinafter), a combination of (i) a light-sensitive element comprising a support having provided thereon at least one layer containing a light-sensitive silver halide, a binder, and a dye providing substance and (ii) a dye fixing element comprising a mordant capable of fixing a mobile dye formed in the light-sensitive element, wherein the dye fixing element further comprises at least one of oil droplets and a latex comprising a polymer having a glass transition point of 40° C. or less.

DETAILED DESCRIPTION OF THE INVENTION

In the present invention, the oil droplets and/or the latex may be incorporated in any layer of the dye fixing element.

The dye fixing element as used herein preferably comprises at least two hydrophilic colloid layers. One of the two hydrophilic colloid layers is a mordanting layer containing a mordant. In the present invention, the oil droplets are preferably incorporated in at least one layer other than the uppermost layer, i.e., layers underlying the uppermost layer among the above plurality of hydrophilic colloid layers. The uppermost layer is a layer coming into contact with the light-sensitive element. Examples of the layers suitable for incorporation of the oil droplets include a mordanting layer which is not the uppermost layer, a layer provided between the uppermost layer and the mordanting layer, and a layer underlying the mordanting layer. Preferred examples of the layer construction of the dye fixing element of the present invention include:

uppermost layer/mordanting layer containing the oil droplets;

uppermost layer/mordanting layer/layer containing the oil droplets; and uppermost layer/mordanting layer containing the oil droplets/layer containing the oil droplets. In the above layer structures, the uppermost layer may be a hydrophilic layer which may function as a protective layer.

The expression "oil droplets" as used herein means substantially water-insoluble oily liquid particles finely and independently dispersed in hydrophilic colloid. The size of the oil droplet is preferably fine; i.e., the average particle diameter is preferably not more than 3 micrometers, more preferably not more than 1 micrometer, and particularly preferably not more than 0.5 micrometer. The amount of the oil droplets added is preferably from 5 to 60 vol %, more preferably from 10 to 50 vol %, and particularly preferably from 20 to 40 vol % based on the total amount of the polymer components (i.e., a binder, a mordant, etc.) in the layer to which the oil droplets are added. If the amount of the oil droplets added is too small, the effect of inhibiting cracking cannot be exhibited sufficiently. On the other hand, if the amount of the oil droplets added is too large, problems such as a reduction of the layer strength, peeling of the layer, and oozing of the oil to the surface layer arise.

In preparation of the oil droplets as used herein, high boiling point organic solvents which exist in a liquid state at ordinary temperature and do not evaporate at the heat processing temperature, such as esters (e.g., phthalic acid esters, phosphoric acid esters, fatty acid esters, etc.), amides (e.g., fatty acid amides, sulfoamides, etc.), ethers, alcohols, and paraffins as described, for example, in U.S. Pat. Nos. 2,322,027, 2,535,514, 2,882,157, 2,353,262, 3,676,142, 3,600,454, Japanese Patent Publication No. 23233/71, British Patents 958,441, 1,222,753, Japanese Patent Application (OPI) Nos. 82078/75, 28921/76, 141623/76 are preferred.

In addition, compounds which are solid individually at ordinary temperature, but when combined with one another, cause a drop in melting point and are present in liquid state in the coating are considered as constituting oil droplets.

In addition, compounds which are solid individually at ordinary temperature, but when incorporated in a hydrophilic binder or when various photographic additives are added, are present in the form of liquid droplets are considered as constituting oil droplets. Examples of such compounds include stilbene, triazine, oxazole and cumarine compounds which are used as a whitening agent, and benzotriazole, thiazoline, and cinnamic acid esters which are used as a ultraviolet ray absorbing agent.

Oil droplets which is preferably used in the present invention comprise a substituted or unsubstituted saturated or unsaturated hydrocarbon having at least 10 carbon atoms (including hydrocarbons in which a part or all of the hydrogens are substituted with halogen atoms), or a compound represented by formula (A), (B), (C), (D), (E), (F), or (G):

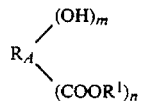

(A)

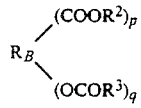

(B)

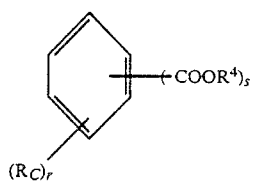

(C)

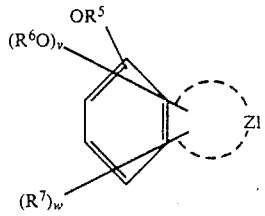

(D)

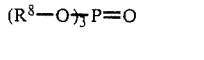

(E)

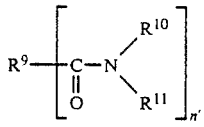

(F)

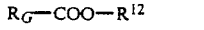

(G)

In formula (A), $R_A$ represents a substituted or unsubstituted aliphatic hydrocarbon group having a valency of m+n, $R^1$ represents a substituted or unsubstituted aliphatic, alicyclic, or aromatic hydrocarbon group, and m and n each represent an integer of from 1 to 5.

In formula (B), $R_B$ represents a substituted or unsubstituted aliphatic or alicyclic hydrocarbon group having a valency of p+q; $R^2$ and $R^3$ may be the same or different, and each represents a substituted or unsubstituted aliphatic or alicyclic hydrocarbon group; p represents 0, 1, 2, or 3; and q represents 0, 1, 2, or 3, provided that p+q represents 1 or more.

In formula (C), $R_C$ represents a hydrogen atom, or a substituted or unsubstituted aliphatic hydrocarbon, alicyclic hydrocarbon, aromatic hydrocarbon, acyl, amino, acyloxy, carbamoyl, ureido, alkoxycarbonyl, aryloxycarbonyl, or cycloalkyloxycarbonyl group, or a halogen atom, a hydroxyl group, a carboxyl group, a nitro group, or a cyano group; $R^4$ represents a substituted or unsubstituted aliphatic, alicyclic, or aromatic hydrocarbon group; r represents an integer of from 1 to 5; s represents an integer of from 1 to 4, provided that r+s represents an integer of 6 or less. When r is 2 or more, the $R_C$ groups may be the same or different. When s is 2 or more, the $R^4$ group may be the same or different.

In formula (D), $R^5$ and $R^6$ each represent a substituted or unsubstituted alkyl, monocyclic or polycyclic alicyclic hydrocarbon, aryl, or aralkyl group; $R^7$ represents a substituted or unsubstituted alkyl, aryl, arakyl, or amino group, or a halogen atom; Z represents an atomic group forming a carbon ring to condense with the benzene ring; l represents 0 or 1; v represents an integer of from 0 to 2; and w represents an integer of from 0 to 7, provided that v+w represents an integer of 7 or less, in which at least one of $R^6O$ and $R^7$ is substituted in at least one of the benzene ring and a carbon ring condensed with the benzene ring.

In formula (E), the $R^8$ groups (which are the same or different) each represents a substituted or unsubstituted alkyl, cycloalkyl, alkenyl, or aryl group.

In formula (F), $R^9$ represents a hydrogen atom, or a substituted or unsubstituted aliphatic hydrocarbon group having a valency of n'; $R^{10}$ and $R^{11}$ are the same or different and each represent a hydrogen atom, or a substituted or unsubstituted aliphatic or aromatic hydrocarbon group; and n' represents 1 or 2, or $R^9$ and $R^{10}$, and $R^{10}$ and $R^{11}$ are combined together with each other to form a heteroring.

In formula (G), $R_G$ represents a substituted or unsubstituted aliphatic hydrocarbon group; and $R^{12}$ represents a substituted or unsubstituted aliphatic, alicyclic, or aromatic hydrocarbon group.

More preferably, the oil droplets compsise a saturated hydrogarbon compound which is partially or wholly substituted with a chlorine atom, or comprise a phosphate type high boiling point organic solvent represented by formula (E).

Compounds represented by above formulae (A) to (G) are described in more detail in, for example, Japanese Patent Application (OPI) Nos. 178455/84, 178454/84, 178452/84, 178453/84, 178451/84, 178457/84, etc.

Specific examples of compounds which are used to form the oil droplets are shown below.

Fluid paraffins (1)

Chlorinated paraffins (2)

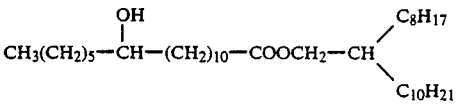
(3)

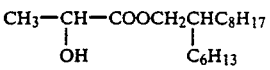
(4)

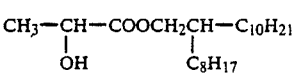
(5)

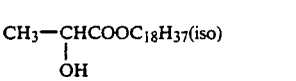
(6)

-continued

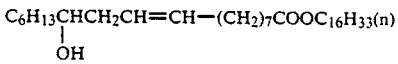
(7)

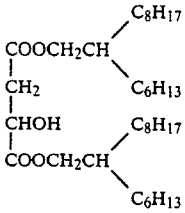
(8)

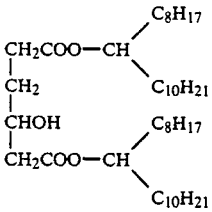
(9)

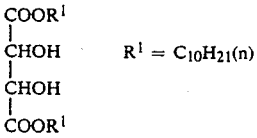
(10)

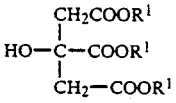

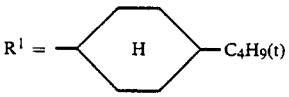
(11)

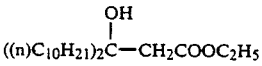
(12)

$C_{13}H_{27}COOC_{18}H_{37}$(iso) (13)

(14)

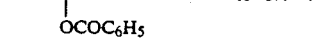
(15)

(16)

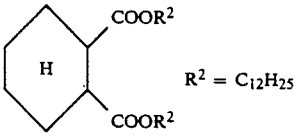
(17)

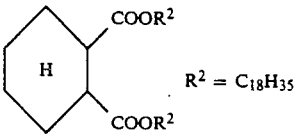
(18)

-continued (19)

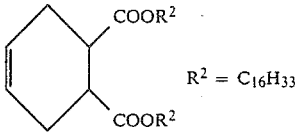

(20)

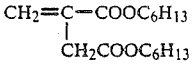

(21)

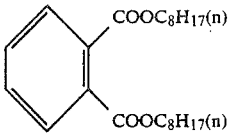

(22)

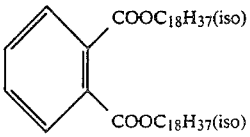

(23)

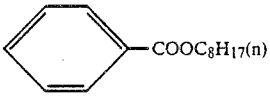

(24)

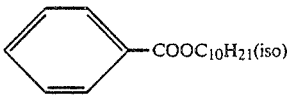

(25)

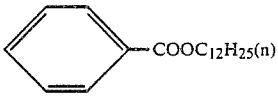

(26)

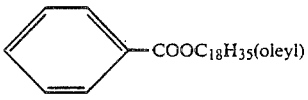

(27)

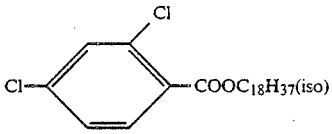

(28)

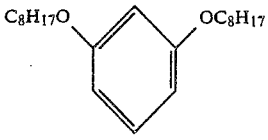

(29)

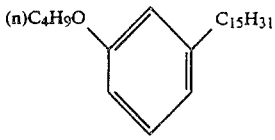

(30)

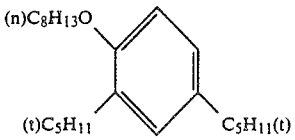

-continued (31)

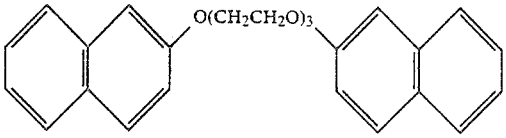

(32) $(C_4H_9O)_3P{=}O$ (33)

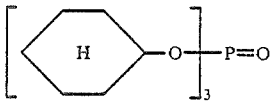

(34) $(C_8H_{17}O)_3P{=}O$

(35) $((iso)C_{10}H_{21})_3P{=}O$

(36) $((n)C_{16}H_{33}O)_3P{=}O$

(37) $((n)C_{18}H_{37}O)_3P{=}O$ (38)

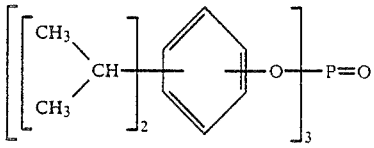

(39) $C_8H_{17}CH{=}CH(CH_2)_{11}CONH_2$ (40)

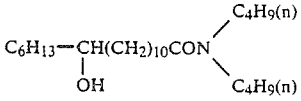

(41)

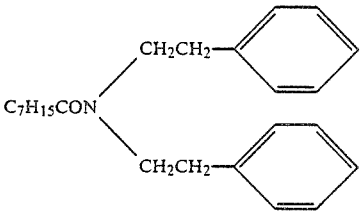

(42) $C_{11}H_{23}CON(C_2H_4OCH_3)_2$

In addition, examples of the compound represented by formula (A) include compounds described in *Yushi Kagaku Binran* (Manual for Chemistry of Fats and Oils), Revised 2nd Ed., 1971, Maruzen, pp. 108 to 115 (Tables 2-31, 2-34, 2-36, 2-39, 2-47).

These compounds are known and are commercially available or can be easily prepared by known preparation methods.

Of the above compounds, low polarity compounds are preferable in view of reducing brittleness of the layer because they less coagulate a coating solution (particularly a coating solution for formation of the mordanting layer). Particularly preferred are compounds having an organic/inorganic value of 3 or more, particularly or 6 more. The organic/inorganic value is a concept to anticipate properties of a compound, and is described more detail, for example, in *Kagaku no Ryoiki* (Field of Chemistry), Vol. 11, page 719 (1957).

Various known methods can be employed to form oil droplets. For example, a compound as described above can be dissolved in a low boiling point organic solvent such as methyl acetate and ethyl acetate if necessary, mixed with an aqueous solution of hydrophilic colloid such as gelatin in combination with a surface active agent, and emulsified and dispersed therein with stirring. Thereafter the resulting dispersion is added to a coating solution for formation of a hydrophilic colloid layer and then coated.

Examples of the monomer which constitutes the polymer latex used in the present invention include acrylic acid esters, methacrylic acid esters, crotonic acid esters, vinyl esters, maleic acid diesters, fumaric acid diesters, itaconic acid diesters, acrylamides, methacrylamides, vinyl ethers, styrens, and the like.

These monomers are described below more specifically.

Examples of acrylic acid esters include methyl acrylate, ethyl acrylate, n-propyl acrylate, isopropyl acrylate, n-butyl acrylate, isobutyl acrylate, tert-butyl acrylate, hexyl acrylate, 2-ethylhexyl acrylate, 2-ethoxy acrylate, 2-(2-methoxyethoxy)ethyl acrylate and the like. Examples of methacrylic acid esters include methyl methacrylate, ethyl methacrylate, n-propyl methacrylate, n-butyl methacrylate, tert-butyl methacrylate, cyclohexyl methacrylate, 2-hydroxyethyl methacrylate, 2-ethoxyethyl methacrylate, and the like. Examples of crotonic acid esters include butyl crotonate, hexyl crotonate and the like. Examples of vinyl esters include vinyl acetate, vinyl propionate, vinyl butyrate, vinyl methoxyacetate, vinyl benzoate, and the like. Examples of maleic acid diesters include diethyl maleate, dimethyl maleate, dibutyl maleate, and the like. Examples of fumaric acid diesters include diethyl fumarate, dimethyl fumarate, dibutyl fumarate, and the like. Examples of itaconic acid diesters include diethyl itaconate, dimethyl itaconate, dibutyl itaconate, and the like. Examples of acrylamides include acrylamide, methacrylamide, ethylacrylamide, propylacrylamide, n-butylacrylamide, tert-butylacrylamide, cyclohexylacrylamide, 2-methoxyethylacrylamide, dimethylacrylamide, diethylacrylamide, phenylacrylamide, and the like. Examples of methacrylamides include methyl methacrylamide, ethyl methacrylamide, n-butyl methacrylamide, tert-butyl methacrylamide, 2-mthoxy methacrylamide, dimethyl methacrylamide, diethyl methacrylamide, and the like. Examples of vinyl ethers include methyl vinyl ether, butyl vinyl ether, hexyl vinyl ether, methoxythyl vinyl ether, dimethylaminoethyl vinyl ether, and the like. Examples of styrenes include styrene, methylstyrene, dimethylstyrene, trimethylstyrene, ethylstyrene, isopropylstyrene, butylstyrene, chloromethylstyrene, methoxystyrene, butoxystyrene, acetoxystyrene, chlorostyrene, dichlorostyrene, bromostyrene, methyl vinylbenzoate, 2-methylstyrene, and the like.

Polymers made up of the above monomers may be homopolymers or copolymers as long as they have a glass transition point of 40° C. or less. Preferred are a polymer of acrylic acid esters, a copolymer of acrylic acid esters and methacrylic acid esters, and a copolymer of acrylic acid esters and acrylic acid or methacrylic acid.

The above polymer latex can be prepared by various methods.

Free radical polymerization of ethylenically unsaturated solid monomers is initiated by addition of a free radical to the monomer. The free radical is formed by thermal decomposition of a chemical initiator, or by the action of a reducing agent with oxidizing compounds (redox initiator), or by the physical action such as irradiation with high energy radiations such as ultraviolet ray and high frequency waves.

Examples of the chemical initiator include persulfates such as ammonium persulfate and potassium persulfate, hydrogen peroxide, 4,4'-azobis(4-cyanovalerianic acid) and the like (which are all water-soluble), and azobisisobutyronitrile, benzoyl peroxide, chlorobenzoyl peroxide, and the like (which are all water-insoluble).

Examples of the redox initiator include hydrogen peroxide-iron (II) salt, potassium persulfate-potassium hydrogensulfate, cerium salt alcohol, and the like.

Examples and action of initiators are described in F. A. Bovey, *Emulsion Polymerization*, Interscience Publishers Inc., New York, pp. 59 to 93 (1955).

As emulsifying agents, compounds having interfacial activity can be used. Preferred examples thereof include soap, sulfonates and sulfates, cationic compounds, amphoteric compounds, and high poymer protective colloid. Examples and action of the above compounds are described in *Beldische Chemische Industrie*, Vol. 28, pp. 16 to 20 (1963).

In the present invention, a latex of a polymer having a glass transition point of 20° C. or less are particularly preferred.

Representative examples of the polymer used in the latex as used in the present invention are shown below, although the present invention is not limited thereto. The copolymerization ratios are indicated in terms of mole percent.

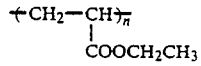
Tg = −21° C. P-1

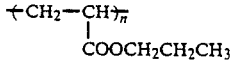
Tg = −36° C. P-2

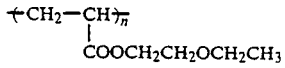
Tg = −47° C. P-3

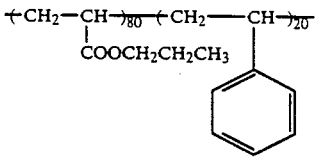
Tg = −20° C. P-4

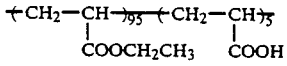
Tg = −11° C. P-5

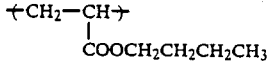
Tg = −53° C. P-6

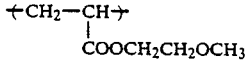
Tg = −45° C. P-7

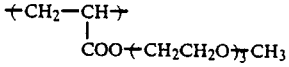
Tg = −36° C. P-8

-continued

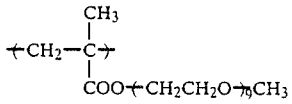

Tg = −18° C. P-9

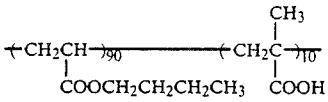

Tg = −26° C. P-10

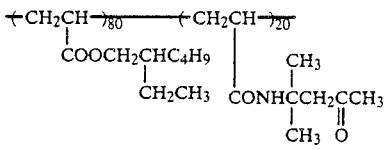

Tg = −17° C. P-11

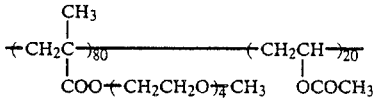

Tg = 4° C. P-12

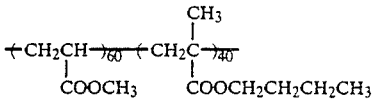

Tg = 15° C. P-13

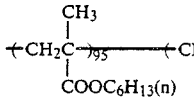

Tg = 6° C. P-14

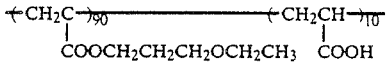

Tg = 2° C. P-15

(Copolymerization ratio: mol %)

The amount of the polymer latex added is defined as a ratio of the total volume of the polymer contained in the latex added to the total volume of a hydrophilic binder contained in the layer to which the latex is added. The amount of the polymer latex added is preferably from 5 to 200 vol %, and more preferably from 10 to 100 vol %. If the amount of the polymer latex added is less than 5 vol %, the cracking preventing effect is poor. On the other hand, if it is in excess of 200 vol %, there is a tendency that the film strength is weakened and the maximum density is decreased. The amount of the polymer latex coated is preferably from 1 $mg/m^2$ to 5 $g/m^2$ and more preferably from 10 $mg/m^2$ to 2 $g/m^2$ as the weight of the polymer contained in the latex.

The effect of the polymer latex as used herein is markedly high when a polymer mordant having a high glass transition point is used.

It is preferable that the polymer latex as used herein is incorporated in a layer adjacent to the mordanting layer containing the mordant. However the polymer latex may be incorporated in the mordanting layer.

In a case where the oil droplets and the polymer latex are used in combination, it is preferable that the oil droplets are incorporated in a mordanting layer which is not the uppermost layer, a layer provided between the uppermost layer and the mordanting layer, a layer provided below the mordanting layer and so forth. The layer in which the polymer latex is to be incorporated may be a hydrophilic colloid layer provided above the mordanting layer which may be the uppermost layer. The oil droplets and the polymer latex may be incorporated in the same hydrophilic colloid layer. It is preferred, however, that a polymer latex-containing layer be provided above the oil droplet containing layer. It is more preferred that the oil droplets are contained in a hydrophilic colloid layer other than the uppermost layer, and the latex is contained in a hydrophilic colloid layer positioned on or above the mordant layer. Examples of the layer structure of the dye fixing element according to the present invention include:

uppermost layer containing a polymer latex/mordanting layer containing oil droplets;

uppermost layer containing a polymer latex/intermediate layer containing oil droplets/mordanting layer;

uppermost layer/intermediate layer containing a polymer latex/mordanting layer containing oil droplets;

uppermost layer containing a polymer latex/mordanting layer containing oil droplets/subbing layer containing oil droplets; and uppermost layer containing a polymer latex/mordanting layer/subbing layer containing oil droplets.

In the present invention, the brittleness of dye fixing element constituting layers, particularly a mordanting layer is improved, and the dye fixing element has less tendency to crack. Particularly, when oil droplets are added to a layer other than the uppermost layer, the surface gloss of the dye fixing element is not reduced. In addition, the present invention produces an advantage that the fog density (Dmin) of a transferred dye image is lowered.

There is no special limitation on the polymeric mordant used in the present invention. However, polymers having a vinyl monomer unit containing a tertiary amino group or a quaternary ammonio group as represented by formula (I), (II), (III) or (IV) as shown below are preferred.

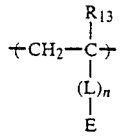

(I)

In formula (I), $R_{13}$ represents a hydrogen atom or a lower alkyl group having from 1 to 6 carbon atoms; L represents a divalent linking group having from 1 to about 20 carbon atoms; E represents a heterocyclic group containing a nitrogen atom connected to a carbon atom with a double bond as a constituting component; and n represents 0 or 1.

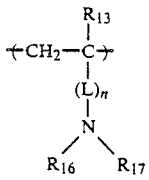

(II)

In formula (II), $R_{13}$, L, and n are the same as defined for formula (I), and $R_{16}$ and $R_{17}$ (which may be the same or different) each represents an alkyl group having 1 to 12 carbon atoms or an aralkyl group having from 7 to 20 carbon atoms, or combine together to form a ring-like structure in combination with the nitrogen atom to which they are bonded.

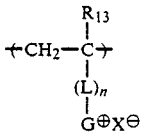

(III)

In formula (II), $R_{13}$, L and n are the same as defined for formula (I); $G^{\oplus}$ represents a hetero ring containing a nitrogen atom quaternized and having a double bond with a carbon atom as a constituting component, and $X^{\ominus}$ represents a monovalent cation.

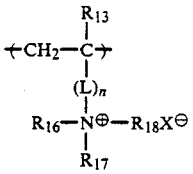

(IV)

In formula (IV), $R_{13}$, L and n are the same as defined for formula (I); $R_{16}$ and $R_{17}$ are the same as defined for formula (II); $R^{18}$ is selected from the groups represented by $R_{16}$ and $R_{17}$; and $X^{63}$ is the same as defined for formula (III); or $R_{16}$, $R_{17}$, and $R^{18}$ combine together to form a ring structure in combination with the nitrogen atom to which they are bonded.

In formulae (I) to (IV), $R_{13}$ represents a hydrogen atom or a lower alkyl group having from 1 to 6 carbon atoms, such as a methyl group, an ethyl group, a n-propyl group, a n-butyl group, a n-amyl group and a n-hexyl group. Particularly preferred is a hydrogen atom or a methyl group.

L represents a divalent linking group having from 1 to about 20 carbon atoms, such as an alkylene group (e.g., a methylene group, an ethylene group, a trimethylene group, and a hexamethylene group), a phenylene group (e.g., an o-phenylene group, a p-phenylene group and a m-phenylene group), an arylenealkylene group (e.g.,

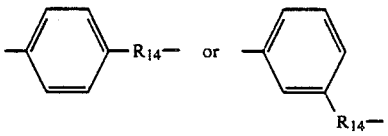

(wherein $R^{14}$ represents an alkylene group having from 1 to about 20 carbon atoms)), $—CO_2—$, $—CO_2-R_{15}—$ (wherein $R_{15}$ represents an alkylene group, a phenylene group or an arylenealkylene group), $—CONH-R_{15}—$ (wherein $R_{15}$ is the same as defined above),

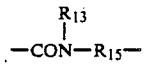

(wherein $R_{13}$ and $R_{15}$ are the same as defined above), and the like. The following are particularly preferred.

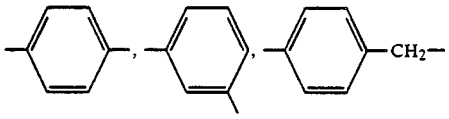

-continued

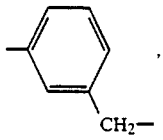

, $—CO_2—$, $—CONH—$, $—CO_2—CH_2CH_2—$, $—CO_2—CH_2CH_2CH_2—$, $—CONHCH_2—$, $—CONHCH_2CH_2—$, $—CONHCH_2CH_2CH_2—$

In formula (I), E represents a hetero ring containing a nitrogen atom having a double bond with a carbon atom as a constituting component. Examples thereof include an imidazole ring (e.g.,

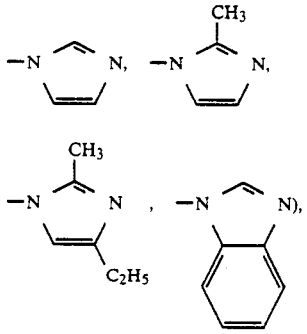

a triazole ring (e.g.,

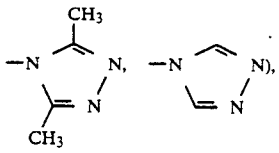

a pyrazole ring (e.g.,

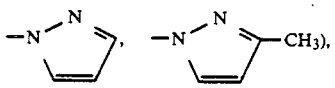

a pyridine ring (e.g.,

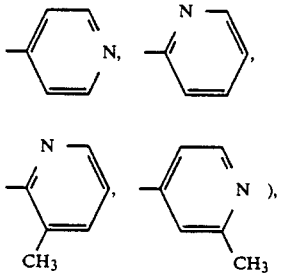

a pyrimidine ring (e.g.,

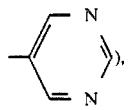

and the like. Particularly preferred examples are an imidazole ring and a pyridine ring.

Preferred examples of the polymer containing a tertiary amino group-containing vinyl monomer unit as represented by formula (I), as well as the mordants described in U.S. Pat. Nos. 4,282,305, 4,115,124 and 3,148,061, include the following. The copolyermization ratios are indicated in terms of mole percent.

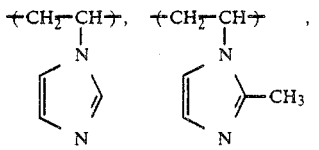

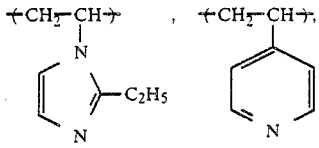

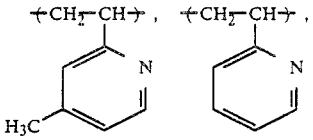

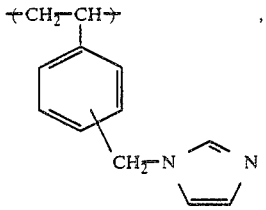

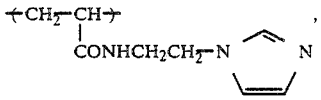

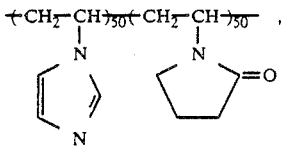

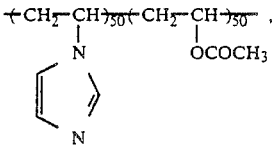

-continued

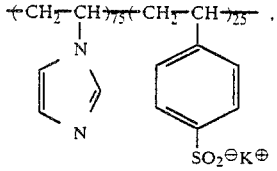

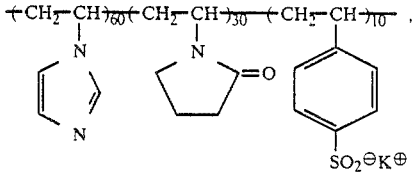

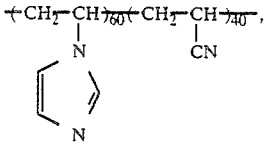

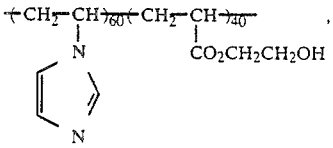

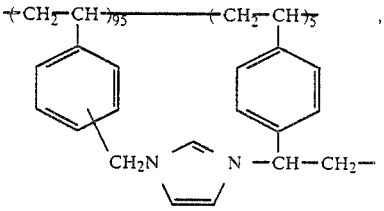

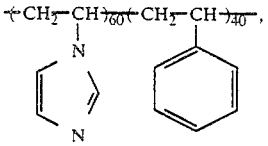

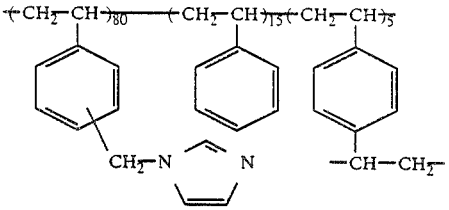

In formula (II), $R_{16}$ and $R_{17}$ each represent an alkyl group having from 1 to 12 carbon atoms, such as an unsubstituted alkyl group (e.g., a methyl group, an ethyl group, a n-propyl group, a n-butyl group, a n-amyl group, a hexyl group, a n nonyl group, a n-doecyl group and a n-dodecyl group) and a substituted alkyl group (e.g., a methoxyethyl group, a 3-cyanopropyl group, an ethoxycarbonylethyl group, an acetoxyethyl group, a hydroxyethyl group, and a 2-butenyl group), or an aralkyl group having from 7 to 20 carbon atoms, such as an unsubstituted aralkyl group (e.g., a benzyl group, a phenetyl group, a diphenylmethyl group, and a naphthylmethyl group) and a substituted aralkyl group (e.g., a 4-methylbenzyl group, a 4-isopropylbenzyl group, a 4-methoxybenzyl group, a 4-(4-methoxyphenyl)benzyl group and a 3-chlorobenzyl group).

Examples of the ring structure resulting from combining $R_{16}$ and $R_{17}$ in combination with a nitrogen atom include

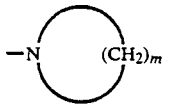

wherein m represents an integer of 4 to 12,

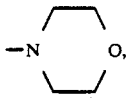

and the like.

Preferred examples of the polymer containing a tertiary amino group-containing vinyl monomer unit as represented by formula (II) are shown below. The copolymerization ratios are indicated in terms of mole percent.

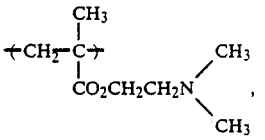

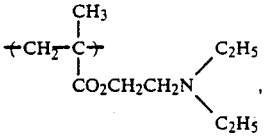

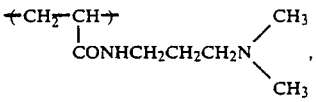

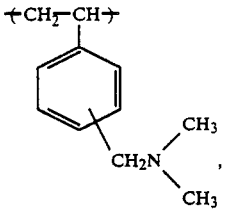

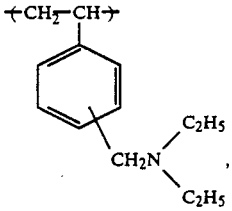

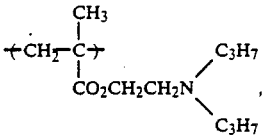

-continued

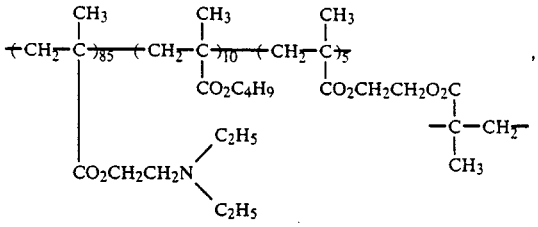

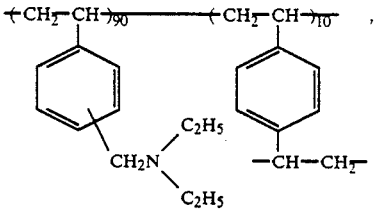

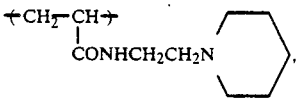

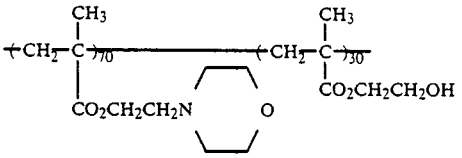

In formula (III), $G^{\oplus}$ represents a hetero ring containing a nitrogen atom which is quaternized having a double bond with a carbon atom as a constituting component. Examples thereof include an imidazolium salt e.g.,

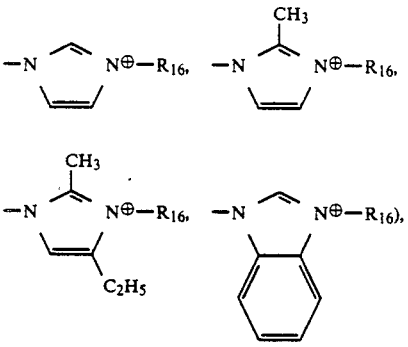

a triazolium salt e.g.,

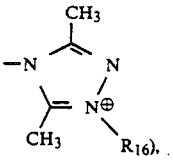

and a pyridinium salt (e.g.,

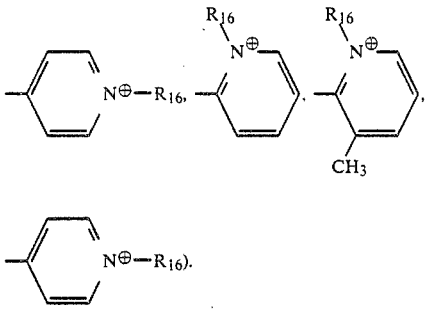

Of these rings, an imidazolium salt and a pyridinium salt are particular preferred. In the above formulae, $R_{16}$ represents the same as in formula (II). Particularly preferred are a methyl group, an ethyl group, and a benzyl group.

In formulae (III) and (IV), $X^{\ominus}$ represents an anion. Examples thereof include a halogen ion (e.g., a chlorine ion, a bromine ion and an iodine ion), an alkyl sulfuric acid ion (e.g., a methylsulfuric acid ion and an ethylsulfuric acid ion), an alkyl or arylsulfonic acid ion (e.g., methanesulfonic acid, ethanesulfonic acid, benzenesulfonic acid, and p-toluenesulfonic acid), an acetic acid ion, and a sulfuric acid ion. Particularly preferred are a chlorine ion and a p-toluenesulfonic acid ion.

Representative examples of the polymer containing a quaternary ammonium group-containing vinyl monomer unit, as well as the mordants described in British Patents 2,056,101, 2,093,041, 1,594,961, U.S. Pat. Nos. 4,124,386, 4,115,124, 4,273,853, 4,450,224, and Japanese Patent Application (OPI) No. 28225/73, include the following.

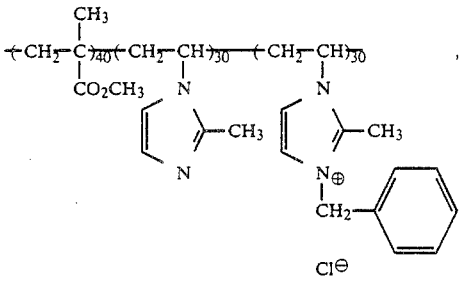

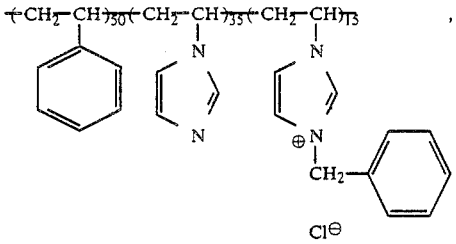

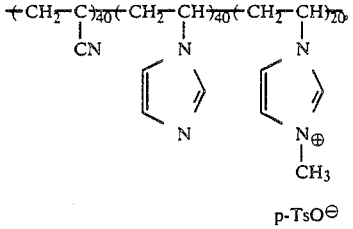

-continued

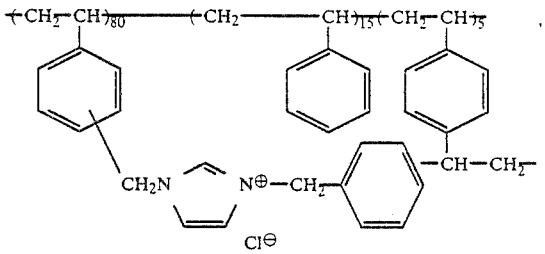

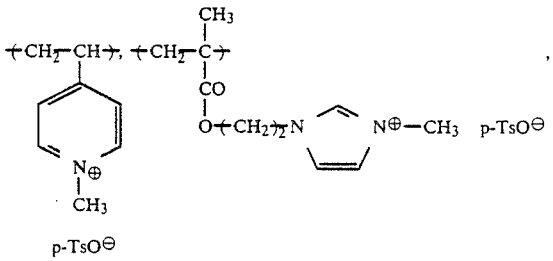

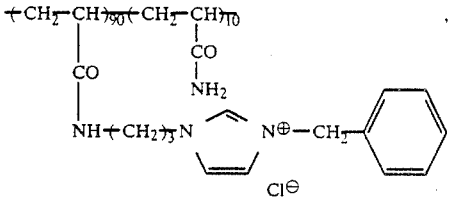

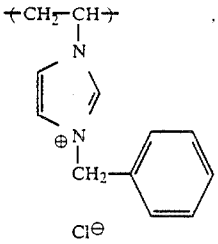

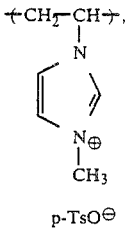

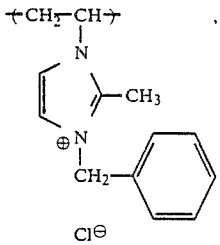

-continued

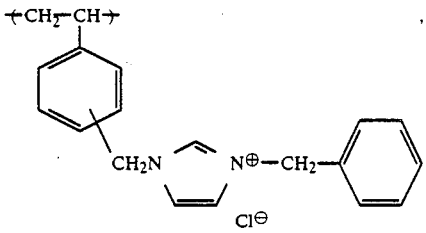

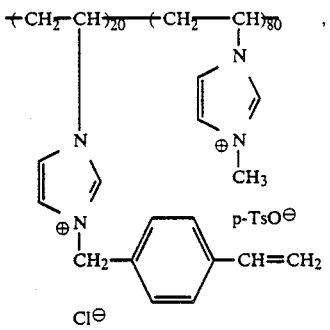

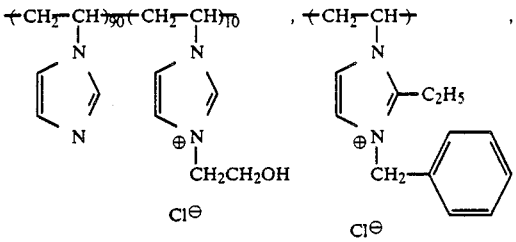

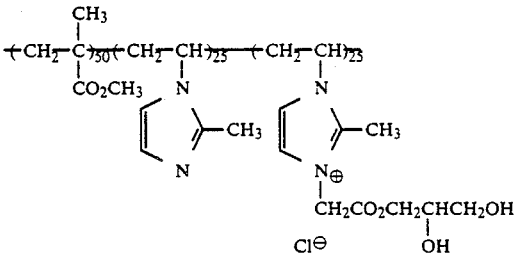

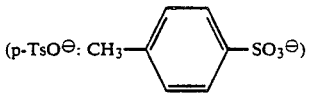

Examples of the ring structure resulting from combining $R_{16}$ and $R_{17}$ in formula (IV) include

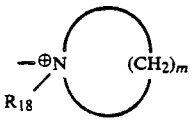

(wherein m represents an integer of 4 to 12), and

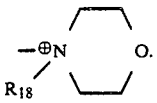

An example of the ring structure as derived from $R_{16}$, $R_{17}$ and $R_{18}$ is

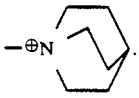

Representative examples of the polymer containing a quarternary ammonio group-containing vinyl monomer unit represented by formula (IV), which are described in U.S. Pat. Nos. 3,709,690, 3,898,088, 3,958,995, etc., as well as the mordants, include the following.

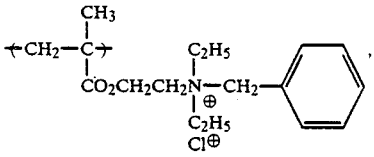

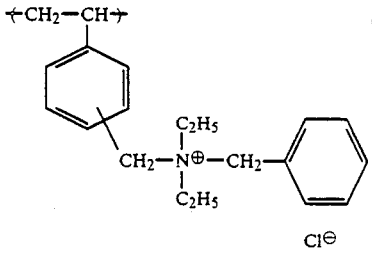

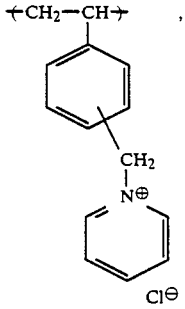

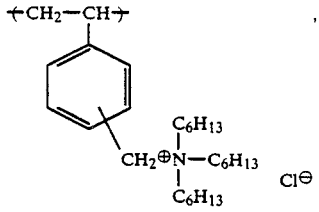

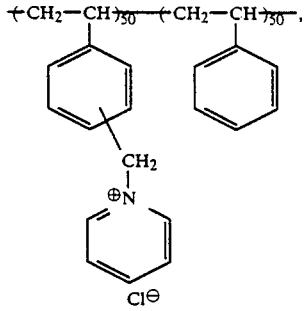

-continued

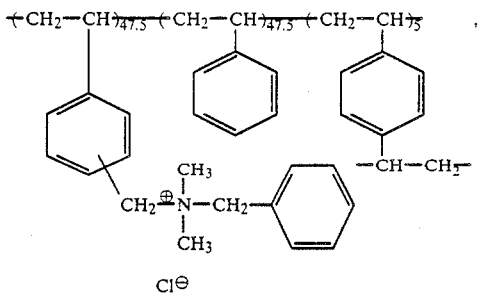

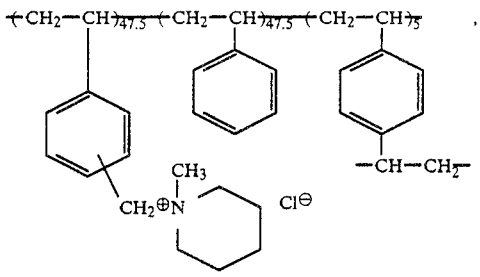

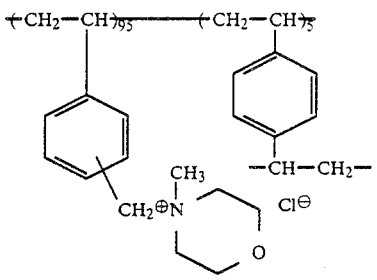

Other polymeric mordants which can be used include vinylpyridine polymers and vinylprydinium cation polymers as described in U.S. Pat. Nos. 2,548,564, 2,484,430, 3,148,061, 3,756,814, etc.; polymeric mordants capable of cross-linking with gelatin and the like, as described in U.S. Patents 3,625,694, 3,859,096, 4,128,538, British Patent 1,277,453, etc.; aqueous sol-type mordants as described in U.S. Patents 3,958,995, 2,721,852, 2,798,063, Japanese Patent Application (OPI) Nos. 115228/79, 145529/79, 126027/79, etc.; water-insoluble mordants as described in U.S. Pat. No. 3,898,088; reactive mordants capable of undergoing a covalent bonding with dyes as described in U.S. Pat. No. 4,168,976 (corresponding to Japanese Patent Application (OPI) No. 137333/79); mordants as described in U.S. Pat. Nos. 3,709,690, 3,788,855, 3,642,482, 3,488,706, 3,557,066, 3,271,147, 3,271,148, Japanese Patent Application (OPI) Nos. 71332/75, 30328/78, 155528/77, 125/78 and 1024/78; and mordants as described in U.S. Pat. Nos. 2,675,316 and 2,882,156.

Particularly preferred polymeric mordant used in the present invention is a polymer containing a vinyl monomer unit represented by formula (I) in which E represents an imidazole ring.

The molecular weight of the polymeric mordant as used in the present invention is preferably from 1,000 to 1,000,000, and more preferably from 10,000 to 200,000.

The polymeric mordant is used in the mordanting layer of the dye-fixing element in combination with hydrophilic colloid as a binder. Typical examples of such hydrophilic colloids include natural substances, e.g., proteins such as gelatin and gelatin deriatives, and polysccharides such as cellulose derivatives, starch and gum arabic, and synthetic polymers such a polyvinyl alcohol, polyvinyl pyrrolidone and polyacrylamide. Of these compounds, gelatin and polyvinyl alcohol are particularly preferred.

The mixing ratio of the polymeric mordant to the hydrophilic colloid and the amount of the polymeric mordant coated can be easily determined by one skilled in the art depending on, for example, the amount of a dye to be mordanted, the type and composition of the polymer mordant, and the image-forming method utilized. It is preferred that the mordant/hydrophilic colloid ratio be from 20/80 to 80/20 (by weight), and that the amount of the mordant coated be about from 0.2 to 15 kg/m$^2$, with the range of 0.5 to 8 g/m$^2$ being more preferred.

The transferred density of the dye can be increased by using the polymer mordant in combination with metal ions in the dye fixing element. This metal ion can be added to the mordanting layer containing a mordant or an adjacent layer (which may be closer to the support than the mordanting layer or further from the support than the mordanting layer). It is preferred for the metal ion to be colorless and stable against heat and light. Transition metal polyvalent ions such as $Cu^{2+}$, $Zn^{2+}$, $Pt^{2+}$, $Pd^{2+}$ and $Co^{3+}$ are preferred. Particularly preferred is $Zn^{2+}$. Generally, metal ion $Zn^{2+}$ is added in the form of water-soluble compounds e.g., $ZnSO_4$ or $Zn(CH_3CO_2)_2$ and the amount of the metal ion added is about from 0.01 to 5 g/m$^2$, with the range of 0.1 to 1.5 g/m$^2$ being preferred.

In a layer to which the above metal ion is added, a hydrophilic polymer can be used as a binder. As these hydrophilic binders, hydrophilic colloids specifically listed in connection with the mordanting layer can be used.

The mordanting layer containing a polymeric mordant can contain various surface active agents for the purpose of increasing coating properties for example.

In addition, a gelatin hardener can be used in combination in the mordanting layer.

Examples of the gelatin hardeners which can be used in the present invention include aldehydes (e.g., formaldehyde, glyoxal, glutaraldehyde, etc.), N-methylol compounds (e.g, dimethylol urea, methyloldimethyl hydantoin, etc.), dioxane derivatives (e.g., 2,3-dihydroxydioxane, etc.), active vinyl compounds (e.g., 1,3,5-triacryloylhexahydro-s-triazine, bis(vinylsulfonyl) methyl ether, N,N'-ethylene-bis(vinylsulfonylaetamide), N,N'-trimethylene-bis(vinylsulfonylacetamide), etc.) active halogen compounds (e.g., 2,4-dichloro-6-hydroxy-s-triazine, etc.), mucohalogenic acids (e.g., mucochloric acid, mucophen-oxychloric acid, etc.), epoxy compounds (e.g.,

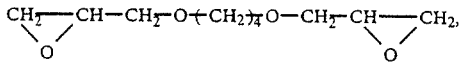

isooxazoles, dialdehyde starch, 1-chloro-6-hydroxy triadinylated gelatin and the like, Representative examples thereof are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,490,911, 3,539,644, 3,543,292, British Patents 676,628, 825,544, 1,270,578, German Patents 872,153, 1,090,427, 2,749,260, and Japanese Patent Publication Nos. 7133/59 and 1872/71.

Of these gelatin hardeners, aldehydes, active vinyl compounds, and active halogen compounds are preferred.

These hardeners may be added directly to a coating solution for formation of the mordnating layer, and they may be added to another coating solution and be allowed to diffuse in the mordanting layer during the process of coating a plurality of layers.

The amount of the gelatin hardener used in the present invention can be determined appropriately by one skilled in the art depending on the purpose. The amount of the gelatin hardener used is generally about from 0.1 to 20 wt %, and preferably from 1 to 8 wt %, based on the weight of the binder such as gelatin.

In accordance with the present invention, a combination of the dye fixing element and the light-sensitive element is heated in the presence of water and a base and/or a base precursor to form imagewise a mobile dye, and simultaneously with this heating, the mobile dye is transferred to the dye fixing element The photographic mateial used in the present invention preferbly comprises a light-sensitive element comprising a support having provided thereon a light-sensijtive layer (I), wherein said light-sensitive layer contains at least silver halide, if necessary an organic silver slt oxidizing agent, if necessary a reducing agent, a dye providing substance, and a binder, and a dye fixing element comprising a dye fixing layer (II) capable of receiving a diffusing dye formed in the light-sensitive layer (I).

The above light-sensitive layer (I) and dye fixing layer (II) may be provided on the same support or different supports. The dye fixing layer (II) and the light-sensitive layer (I) can be peeled apart. For example, after imagewise exposure followed by uniform heat development, the dye fixing layer (II) or light-sensitive layer can be peeled apart. In a case where a light-sensitive element with with a light-sensitive layer (I) coated on a support and a dye-fixing element with a dye fixing layer (II) coated on a support are formed independently, the light-sensitive element is imagewise exposed, the dye fixing element is superposed on the light-sensitive element, they are then heated in the presence of water whereby a diffusing dye can be transferred to the dye fixing layer (II) and, thereafter, the elements are separated and a dye image is observed on the dye fixing layer (II).

In the present invention, water may be supplied in any desired manner. For example, water may be jetted through fine holes, or water wetting may be carried out using a web roller. Altanatively, water may be supplied by collapsing a pod containing water. The present invention is not limited to the above methods or other methods. In addition, part of the water may be incorporated in the elements in the form of water of frystallization or water in microcapsules.

The water as used herein is not limited to so-called pure water and includes water in the commonly used in the field of photography. A mixed solvent of water and a low boiling solvent such asmethanol, DMF, acetone, diisobutylketone, etc. can be used. In addition, a solution containing an image formation accelerating agent, a hydrophilic heat solvent and the like can be used. When water is supplied from the outside, it is necessary to supply a constant amount of water to the light-sensitive element and/or the dye-fixing element in order to obtain a uniform image. In a case where water is supplied in an amount smaller than the maximum swelling amount of the layers, an image is formed unevenly by repelling on the element surface, unevenness in permeation of water in the layers and so forth. Therefore, in order to improve spreading of water on a material surface, a surface active agent may be incorporated.

As the above surface active agent, surface active agents which are commonly known in the art as a swelling agent or a wetting agent can be used. There surface active agents are described in a number of literatures such as *Kaimen Kasseizai Binran* (Manual for Surface Active Agents) edited by Ichiro Nishi et al, Sangyo Tosho,Co., Ltd. (1960), *Surfactant Science Series*, edited by Martin. J. Schick, Marcel Dekker Inc. (1967), and so forth. Any of anionic, cationic, amphoteric, and nonionic surface active agents can be used. Two or more surface active agents may be used in combination.

The amount of the surface active agent used in the present invention varies depending on the type of the surface active agent. It is preferred that they are added in such a manner that the surface tension is not more than 40 dyne/cm.

The amount of water added in the present invention is preferably at least 0.1 times the total weight of coatings of the light-sensitive and dye fixing elements. It is more preferably in the range of from 0.1 times the total weight of coatings to a weight of water corresponding to the maximum swollen volume of the coatings, and particularly preferably is in the range of from 0.1 times the total weight of coatings to an amount obtained by subtracting the weight of coatings from the weight of water corresponding to the maximum swollen volume of coatings.

The state of the layers in the swollen condition is unstable. Depending on the conditions, the layers tend to show blotting occurring locally. In order to eliminate this problem, it is preferred for water to be added in an amount not more than the amount of water corresponding to the volume at maximum swelling of all coatings of the light-sensitive and dye-fixing elements. More specifically the amount of water is preferably from 1 to 50 g, more preferably from 2 to 35 g and particularly preferably from 3 to 25 g, per square meter of the total area of the light-sensitive and dye fixing elements.

However in connecting with the effects of the present invention, only the above problem (i.e., tendency to show blotting) arise even when the amount of water is greater than the above preferred amount, and the effects of the present invention are attained the same as in the case wherein the amount of water is in the above preferred range.

The degree of swelling of the gelatin film markedly varies with the degree of hardening. Usually the degree of hardening is controlled so that the film thickness at the time of maximum swelling is from 2 to 6 times the dry film thickness.

In the present invention, heat is applied. Since a relatively large amount of a water solvent is contained in the element, the maximum temperature of the light-sensitive element is determined by the boiling point of the aqueous solution (with various additives dissolved therein) contained in the light-sensitive element. The lowest temperature is preferably not less than 50° C. The boiling point of water is 100° C. under atmospheric pressure. If the light-sensitive element is heated to more than 100° C., water is evaporated. Thus it is preferred that the surface of the light-sensitive element is covered with a water impermeable material or high temperature and high pressure steam is supplied for heating. In this case, since the boiling point of the aqueous solution increases, the temperature of the light-sensitive element also advantageously increases.

A heating means may be a heat generating plate or its similar member, utilizing a hot plate, an iron, a heat roller, carbon or titanium white and the like. It is also possible that a heat generating layer is provided in the light-sensitive element and/or the dye-fixing element and electricity is passed through the layer to thereby apply heating.

The base and/or base precursor as used in the present invention may be incorporated in the water used in the present invention, or in the light-sensitive element and/or dye fixing element.

Bases which can be used in the present invention include inorganic bases such as hydroxides, carbonic acid salts, hydrogencarbonic acid salts, boric acid salts, secondary or tertiary phosphoric acid salts, qiunolic acid salts, metaboric acid salts, etc., of alkali metals, alkaline earth metals, ammonia, quaternary alkylammonium etc.; organic bases such as aliphatic amine (e.g., trialkylamines, hydroxylamines aliphatic polyamines etc.), aromatic amines (e.g., N-alkyl-substituted aromatic amines, N hydroxyalkyl-substituted aromatic amines, bis(p-(dialkylamino)phenylmethanes etc.), heterocyclic amines, amidines, cyclic amidine, guamidines, cyclic guanidines etc., and their carbonic acid salts, hydrogencarbonic acid salts, boric acid salts, phophoric acid, phospheric acid salts etc. In addition, tetramethylammonium betaine iodide and dimainobutane dihydrochloride as described in U.S. Pat. No. 2,410,644, and organic compounds containing amino acid such as urea and 6-aminocaproic acid as described in U.S. Pat. No. 3,506,444 can be used. In the present invention, compounds having a pKa of not less than 8 are particularly preferred.

The base precursor as used in the present invention includes a compound releasing or forming a base through heat decomposition, electrolysis, complex-forming reaction and so forth.

Examples of such base precursors are compounds releasing a base by heating, such as a salt of an organic acid and a base which is decomposed while releasing carbonic acid, and a compound releasing amine through decomposition by the Lossen rearrangement, the Beckmann rearangement, and so forth.

As the bases for use in preparation of the above salts formed of an organic acid and a base, inoganic or organic bases as described above can be used. Examples of the organic acid include trichloroacetic acid, trifluoroacetic acid, propiolic acid, cyanoacetic acid, sulfonylacetic acid, acetoacetic acid, et., and 2-carboxycarboxamide described in U.S. Pat. No. 4,088,496.

In addition to the salts of an organic acid and a base, hydroxamcarbamates utilizing the Lossen rearrangement as described in Japanese Patent Application (OPI) No. 168440/84, aldoxim carbamates forming nitrile as described in Japanese Patent Application (OPI) No. 157637/84, and so forth are effective. Amineimides as described in *Research Disclosure*, May 1977, RD No. 15776, aldonamides described in Japanese Patent Application (OPI) No. 22625/75, and so forth form a base upon decomposition at high temperatures, and are preferably used.

The following are base precursors forming a base by electrolysis.

As an example of the method using electrolytic oxidation, electrolysis of various fatty acid salts can be given. By this reaction, the carbonic acid salts of alkali metals and organic bases such as guanidines and amidines can be obtained very efficiently.

As methods using electrolytic reduction, frmation of amines through reduction of nitro and nitroso compounds, formation of amines through reduction of nitriles, formation of p-aminophenols, p-phenylenediamines and hydrazines through reduction of nitro compounds, azo compounds, azoxy compounds and the like, and so forth can be given. p-Aminophenols, p-phenylenediamines, and hydrazines can be used not only as bases but also as color image-forming substances directly.

In addition, the formation of an alkali component by electrolysis of water in the presence of various inorganic salts can be employed.

As base precursors to form a base using the complex forming reaction, slightly soluble metal compounds and combinations of metal ions constituting this slightly soluble metal compounds and compounds capable of undergoing the complex forming reaction (called "complex-forming compounds") as described in U.S. Pat. No. application Ser. No. 890,442, filed on Jul. 30, 1986 and now U.S. Pat. No. 4,740,445, can be given. Examples of the slightly soluble metal compounds include the carbonates, hydroxides and oxides of zinc, aluminum, calcium and barium can be given. Complex-forming compounds are described in detail in, for example, A. E. Martell & R. M. Smith, *Critical Stability Constants*, Vols. 405, Plenum Press. Specific examples thereof are salts of aminocarboxylic acids, iminodiacetic acids, pyridylcarboxylic acids, aminophosphoric acids, carboxylic acids (mono-, di-, tri and tetracarboxylic acids, and compounds having a substituent such as a phosphono, hydroxy, oxo, este, amido, alkoxy, mercapto, alkylthio and phosphino substituent), hydroxamic acids, polyacrylates and polyphosphoric acids, and alkali metals, guanidines, amidines, and quaternary ammonium salts.

It is advantageous for these slightly soluble metal compounds and complex-forming compounds to be separately introduced in the light sensitive element and the dye fixing element.

In a case where the slightly soluble metal compound or complex-forming compound is incorporated in a layer on the support, although the amount of the slightly soluble compound or complex-forming compound added varies depending on the type of the compound, the particle size of the slightly soluble metal compound, the complex-forming reaction rate and the like, it is generally added in an amount of not more than 50 wt %, preferably in an amount of from 0.01 to 40 wt % based on the weight of each coating film. In a case where the complex-forming compound is supplied in the form that it is dissolved in water, the concentration is in the range of from preferably 0.005 to 5 mol, and more preferably from 0.05 to 2 mol per liter. In the present invention, the complex-forming compound content of the reaction system is such that the molar ratio of the complex-forming compound to the slightly soluble compound is preferably in the range of from 1/100 to 100/1, and more preferably from 1/10 to 20/1.

The base and/or the base precursor can be used alone, or two or more of the base and/or the base precursor can be used in combination with each other.

The base and/or base precursor can be used in a wide ranging amount. In a case where the base and/or base precursor is used in the conventional light sensitive layer and/or dye fixing layer, generally each is used in an amount of 50 wt % or less based on the weight of the coated layer, with the range of from 0.01 to 40 wt % being preferred. In a case where they are used in a form that they are dissolved in water, the concentration is preferably from 0.005 to 2 mole/l and particularly preferably from 0.05 to 1 mole/l.

The present invention is greatly effective in preventing cracking of the mordanting layer frequently occurring in the dye fixing element containing salts such as the above base precursor (including the complex-forming compound).

Since the present invention utilizes heat development, development can be carried out at a pH much lower than the pH of the film at the time of development in the so-called color diffusion transfer method in which a developer is spread in a film unit and development is performed at a temperature near ordinary temperature. If the pH is increased, fog is markedly increased; this marked increase in fog is undesirable. Therefore the pH of the film at the time of heating for development and dye movement is preferably not more than 12, and more preferably not more than 11.

On the other hand, if the pH is too low, development does not proceed even if heating is applied and thus it is preferable that the pH is not less than 7, with the range of not less than pH 8 being particularly preferred.

Within the above pH range, the fog is low and a high density image cn be obtained in a short time. The pH value of the film can be determined as follows.

The light-sensitive material is heated in the same manner as in development with the exception that imagewise exposure is not applied. When the temperature of the material returns to the ordinary temperature, 20 μl of water is placed thereon. Immediately a pH electrode is brought into close contact, and the pH value in the equilibrium condition is measured.

As the silver halide used in the present invention, any of silver chloride, silver bromide, silver chlorobromide, silver chloroiodide, and silver iodobromide can be used.

More specifically, the silver halide emulsions described, for example, in Japanese Patent Application (OPI) No. 107240/86, U.S. Pat. No. 4,500,626, *Research Disclosure,* June 1978, pp. 9010 (RD 17029), Japanese Patent Application No. 225176/85, and U.S. Pat. No. Application Serial No. 917,642 filed on October 10, 1986, can be used.

The silver halide emulsion may be used without ripening, but generally it is used after chemical sensitization. Conventional sensitization methods such as the sulfur sensitization method, the reduction sensitization method and the noble metal sensitization method can be used alone or in combination with each other. This chemical sensitization can be carried out in the presence of nitrogen-containing heterocyclic compounds (described in Japanese Patent Application (OPI) Nos. 126526/83 and 215644/83).

The silver halide emulsion as used herein may be of the surface latent image type in which a latent image is formed mainly on the particle surface, or of the inner latent image type in which a latent image is formed in the inside of particles. A direct reversal emulsion comprising an inner latent image type emulsion and a nucleating agent can be used.

The amount of the light-sensitive silver halide coated in the present invention is within the range of from 1 $mg/m^2$ to 10 $g/m^2$ as silver.

In the present invention, the light-sensitive silver halide can be used in combination with an organic metal salt as an oxidizing agent. In this case, it is necessary that the light-sensitive silver halide and the organic metal salt are in a contact condition or in a closed location.

Of these organic metal salts, organic silver salts are particularly preferably used.

As organic compounds which can be used to form the above organic silver salt oxidizing agents, compounds described in Japanese Patent Application (OPI) No. 107240/86, and U.S. Pat. No. 4,500,626, can be used. In addition, alkinyl group-containing carboxylic acid silver salts such as silver phenylpropolate as described in Japanese Patent Application (OPI) No. 113235/85 are useful.

The above organic silver salts can be preferably used in an amount of from 0.01 to 10 mol, and more preferably from 0.01 to 1 mol per mol of light-sensitive silver halide. The total amount of the light-sensitive silver halide and the organic silver salt coated is preferred to be from 50 $mg/m^2$ to 10 $g/m^2$, based on the silver content.

The silver halide as used herein may be subjected to spectral sensitization using methine dyes or the like. Dyes which can be used include cyanine dyes, merocyanine dyes, complex cyanine dyes, complex merocyanine dyes, holopolar cyanine dyes, hemicyanine dyes, styryl dyes and hemioxonol dyes.

More specifically, sensitizing dyes described in Japanese Patent Application (OPI) Nos. 180550/84, 140335/85, *Research Disclosure,* June 1978, pp. 12 to 13 (RD 17029), and sensitizing dyes having a heat-decoloring property as described in Japanese Patent Application (OPI) No. 111239/85, and U.S. Pat. No. application Ser. No. 893,851 filed on Aug. 6, 1986 can be used.

These sensitizing dyes can be used alone or in combination with each other. Such combinations of sensitizing dyes are often used for the purpose of super sensitization.

In combination with sensitizing dyes, dyes not having a spectral sensitization action by themselves or substances substantially not absorbing visible light, exhibiting supersensitization may be incorporated in the emulsion (for example, the compounds described in U.S. Pat. Nos. 2,933,390, 3,635,721, 3,743,510, 3,615,613, 3,615,641, 3,617,295 and 3,635,721 can be used).

The sensitizing dye may be added to the emulsion at the time of chemical ripening, or before or after the chemical ripening. In addition, the sensitizing dye may be added before or after the formation of nuclei according to U.S. Pat. Nos. 4,183,756 and 4,225,666.

The amount of the sensitizing dye added is about from $10^{-8}$ to $10^{-2}$ mol per mol of silver halide.

In the present invention, a compound forming or releasing a mobile dye corresponding to or counter-corresponding to the reduction reaction of silver ion into silver, i.e., a dye-providing substance is contained.

The dye-providing substance is hereinafter explained.

Examples of the dye-providing substances which can be used in the present invention include a coupler capable of reacting with a developer. In the system utilizing the coupler, an oxidized product of a developer formed through the redox reaction of a silver salt and the developer reacts with a coupler to thereby form a dye, and this type of system is described in a number of literatures. This coupler may be a 4-equivalent coupler or a 2-equivalent coupler. In addition, 2-equivalent couplers having an anti-diffusing group as a releasing group and forming a diffusible dye through the reaction with an oxidized product of a developer are preferred. Examples of the developer and the coupler are described in detail in T. H. James, *The Theory of the Photographic Process,* pp. 291 to 334 and pp. 354 to 361, Japanese Patent Application (OPI) Nos. 123533/83, 149046/83, 149047/83, 111148/84, 124399/84, 174835/84, 231539/84, 231540/84, 2950/85, 2951/85, 14242/85, 23474/85 and 66249/85.

Other examples of the dye-providing substnce include dye silver compounds resulting from bonding of organic silver salts and dyes. Representative example of such dye silver compounds are described in *Research Disclosure,* May 1978, pp. 54 to 58 (RD-16966).

Other examples of the dye-providing substance include azo dyes which are used in the heat development silver dye bleaching method. Representative examples of the azo dye and a bleaching method are described in U.S. Pat. No. 4,235,957 and *Research Disclosure,* May 1976, pp. 30 to 32 (RD-14433). In addition, leuco dyes described in U.S Pat. Nos. 3,985,565 and 4,022,617 can be used as the dye-providing substances.

Other examples of the dye-providing substance include compounds capable of releasing or diffusing imagewise a diffusible dye. Compounds of this type can be represented by the following formula (LI)

$$(\text{Dye}—X)_n—Y \qquad \text{(LI)}$$

wherein Dye represents a dye group, a dye group in which the absorption wavelength is temporarily shifted to shorter range, or a dye precursor group; X represents a chemical bond or a linking group; Y represents a group having such properties as to form a difference in diffusing properties of the compound represented by formula (LI) corresponding or counter-corresponding to a light-sensitive silver salt having a latent image, or to release Dye and produce a difference in diffusing properties between the released Dye and $(\text{Dye}—X)_n—Y$; n represents 1 or 2; and when n is 2, the two groups (Dye—X) may be the same or different.

As representative examples of the dye-providing substance represented by formula (LI), a dye developing agent resulting from bonding of a hydroquinone-based developing agent and a dye component are described in U.S. Pat. Nos. 3,134,764, 3,362,819, 3,597,200, 3,544,545, 3,482,972, etc; substances releasing a diffusible dye through the intramolecular nucleophilic substitution reaction are described in Japanese Patent Application (OPI) No. 63618/76; and substances releasing a diffusible dye through an intramolecular rewinding reaction is described in Japanese Patent Application (OPI) No. 111628/74. In all of these systems, a diffusible dye is released or diffused in areas where development does not occur, while on the other hand in areas where development occurs, no dye is released or diffused.

A compound group described in Japanese Patent Application No. 244873/85 is known to release a diffusible dye in the similar mechanism as above. These compounds provide a diffusible dye as a result of cleavage of the N-O bond due to the remaining reducing agent.

Another system that has been devised involves a dye releasing compound that is converted into an oxidized product type not having a capability of releasing a dye, and is allowed to coexist with a reducing agent or its precursor, and, after development, it is reduced with reducing agent remaining unoxidized to make it release a diffusible dye. Representative examples of the dye-providing substance used in such system are described in Japanese Patent Application (OPI) No. 110827/78, 130927/79, 164342/81, and 35533/78.

As a substance which releases a diffusing dye in areas where development occurs, substances to release a diffusible dye through the reaction between a coupler having a diffusible dye moiety as a releasing group and an oxidized product of a developer are described in British Patent 1,330,524, Japanese Patent Publication No. 39165/73, and British Patent 3,443,940.

The system using the above color developers has a serious problem that an image is contaminated with oxidization decomposition products of the developers. In order to overcome the problem, dye releasing compounds which do not need any developers and have a reducing ability by themselves have been proposed. Representative examples of such compounds are dye-providing substances described, for example, in U.S. Pat. Nos. 3,928,312, 4,053,312, 4,055,428, 4,336,322, Japanese Patent Application (OPI) Nos. 65839/84, 69839/84, 3819/78, 104343/76, *Research Disclosure,* RD 17465, U.S. Pat. Nos. 3,725,062, 3,728,113, 3,443,939, Japanese Patent Application (OPI) Nos. 116537/83, 179840/82, and U.S. Pat. No. 4,500,626.

Representative examples of dye providing substances which can be used in the present invention include compounds described in U.S. Pat. No. 4,500,626. Of the compounds described therein, Compounds (1) to (3), (10) to (13), (16) to (19), (28) to (30), (33) to (35), (38) to (40), and (42) to (64) are preferred. In addition, compounds described in Japanese Patent Application (OPI) No. 124941/86, are useful. The amount of the compound added is preferably from 0.01 to 10 mmol/m$^2$, and more preferably from 0.05 to 5 mmol/m$^2$.

The above dye-providing compound and hydrophobic additives such as an image formation accelerating agent as described hereinafter can be incorporated in a layer of the light-sensitive element by conventional techniques, such as the method described in U.S. Pat. No. 2,322,027. In this case, high boiling point organic solvents as decribed in Japanese Patent Application (OPI) Nos. 83154/84, 178451/84, 178452/84, 178453/84, 178454/84, 178455/84 and 178457/84 can be used, if necessary in combination with low boiling point organic solvents having a boiling point of from 50° to 160° C.

The amount of the high boiling point organic solvent used is preferably not more than 10 g, and more preferably not more than 5 g, per g of the dye-providing substance.

A dispersion method using polymers as described in Japanese Patent Publication No. 39853/76 and Japanese Patent Application (OPI) No. 59943/76 can be employed.

In the case of compounds which are substantially insoluble in water, a method for dispersing them in a binder as fine particles can be used.

In dispersing hydrophobic substances in a hydrophilic colloid, various surface active agents can be used. As these surface active agents, surface active agents as described in Japanese Patent Application (OPI) No. 157636/84 can be used.

In the present invention, it is preferred to incorporate a reducing substance in the light-sensitive element. As such reducing substances, as well as compounds generally known as reducing agents, the above described dye-providing substances having reducing properties can be used. In addition, reducing agent precursors which do not have reducing properties by themselves, but which exhibit reducing properties by the action of a nucleophilic reagent or heat during the process of development can be used.

As examples of the reducing agents which can be used in the present invention, reducing agents described in, for example, U.S. Pat. Nos. 4,500,626, 4,483,914, Japanese Patent Application (OPI) Nos. 140335/85, 128438/85, 128436/85, 128439/85, and 128437/85 can be used. In addition, reducing agent precursors described in Japanese Patent Application (OPI) Nos. 138736/81, 40245/82 and U.S. Pat. No. 4,330,617 can be used.

Combinations of various developers as described in U.S. Pat. No. 3,039,869 can be used.

In the present invention, the amount of the reducing agent added is preferably from 0.01 to 20 mol, particularly preferably from 0.1 to 10 mol per mol of silver.

In the present invention, an image formation accelerating agent can be incorporated in the light-sensitive element. The image formation accelerating agent has functions such as acceleration of the redox reaction of a silver salt oxidizing agent and a reducing agent, acceleration of reactions such as formation of a dye from a dye-providing substance, decomposition of a dye, and release of the diffusible dye, and acceleration of the transfer of a dye from a light-sensitive element layer to a dye fixing layer. These image formation accelerating agents can be classified into a base or a base precursor, a nucleophilic compound, a high boiling point organic solvent (oil), a heat solvent, a compound having a mutual action with silver or silver ion, and so forth depending on their physical and chemical functions. Usually these substances have a plurality of functions; that is, they have some combination of the above acceleration functions. Details thereof are described, e.g., in Japanese Patent Application (OPI) No. 93451/86.

In the present invention, various development stopping agents can be used for the purpose of obtaining a constant image irrespective of variations in the processing temperature and the processing time in development.

A "development stopping agent" as used herein means a compound quickly neutralizing the base or reacting with the base, thereby decreasing the base concentration in the film and substantially stopping development, or a compound controlling develpment by mutual action with silver or silver salt. More specifically, acid precursors releasing an acid on heating, electrophilic compounds causing a substitution reaction with a coexisting base on heating, nitrogen-containing heterocyclic compounds, mercapto compounds and their precursors, and the like (for example, compounds described in Japanese Patent Application (OPI) Nos. 108837/85, 192939/85, 230133/58, and 230134/85) can be used.

Compounds releasing a mercapto compound on heating are also useful in the present ivention. Examples thereof include compounds described, for example, in Japanese Patent Application (OPI) Nos. 67851/86, 147244/86, 124941/86, 185743/86, 182039/86, 185744/86, 184539/86, 188540/86, and 53632/86.

In the present invention, a compound performing the stabilization of images simultaneously with the activation of development can be used in the light-sensitive element. Preferred examples of such compounds are described in U.S. Pat. No. 4,500,626.

Various antifoggants can be used in the present invention. As these antifoggants, azoles, nitrogen-containing carboxylic acids and phosphoric acids described in Japanese Patent Application (OPI) No. 168442/84, mercapto compound and their metal salts described in Japanese Patent Application (OPI) No. 111636/84, and acetylene compounds described in U.S. patent application Ser. No. 917,642 filed on Oct. 10, 1986 can be used.

In the prsent invention, if desired, an image color controlling agent can be incorprated in the light-sensitive element. Examples of the effective color controlling agents include compounds described in Japanese Patent Application (OPI) No 147244/86.

The light-sensitive and dye-fixing elements of the present invention may contain an inorganic or organic hardener in the photographic emulsion layers and other binder layers.

Examples of the hardeners are described in Japanese Patent Application (OPI) Nos. 147244/86 and 157636/77. These compounds can be used alone or in combination with each other.

The support for use in the light-sensitive and dye-fixing elements of the present invention can withstand the processing temperature. In general, as the support, glass, paper, cast coated paper, synthetic paper, a polymer film, metal and their similar materials can be used. In addition, materials listed as supports in Japanese Patent Application (OPI) No. 147244/86 can be used.

In a case where the light-sensitive element as used herein contains a colored dye-providing substance, the necessity of additionally incorporating an anti-irradiation or anti-halation substance, or various dyes in the light-sensitive element is not so high. However, filter dyes, absorbing substance and the like described in Japanese Patent Application (OPI) No. 147244/86 and U.S. Pat. No. 4,500,626, can be incorporated in the light-sensitive element.

In order to form a wide variety of colors falling within the chromaticity diagram using the three principal colors of yellow, magenta, and cyan, it is necessary for the light-sensitive element as used herein to have at least three silver halide emulsion layers each having light sensitivity in its individual spectral region.

Examples of the combination of at least three light sensitive silver halide emulsion layers having light-sensitivity in spectral regions different from each other are described in Japanese Patent Application (OPI) No. 18055/84.

The light-sensitive element as used herein may have, if desired, two or more emulsion layers having light sensitivity in the same spectral region, but being divided into multiple layers according to the the sensitivity of the emulsions of the respective layers.

The light-sensitive element as used in the present invention, if desired, may contain various additives which are commonly used in conventional heat-developable light-sensitive materials, and may include layers other than the light-sensitive layer such as an antistatic layer, an electrically conductive layer, a protective layer, an intermediate layer, an anti-halation layer, a peeling layer, a matting layer, and the like. The above additives include additives described in, for example, *Research Disclosure*, June 1978, pp. 9 to 15 (RD-17029) and Japanese Patent Application (OPI) No. 88256/86, such as a plasticizer, a sharpness improving dye, an anti-halation dye, a sensitizing dye, a matting agent, a surface active agent, a fluorescent whitening agent, an ultraviolet ray absorbing agent, a sliding preventing agent, an antioxidant, a fading preventing agent, and the like.

In particular, in the protective layer, an organic or inorganic matting agent is generally incorporated for the purpose of preventing adhesion. In addition, a mordant and an ultraviolet ray absorbing agent may be incorporated in the protective layer. The protective and intermediate layers may each be composed of two or more layers.

In the intermediate layer, a reducing agent, an ultraviolet ray absorbing agent and a white pigment such as $TiO_2$ may be incorporated for the purpose of preventing color fading or color mixing. The white pigment may be added not only to the intermediate layer, but also to the emulsion layer for the purpose of increasing sensitivity.

The dye fixing element as used herein carries at least one layer containing a mordant. When the dye fixing layer is exposed outside or positioned uppermost, a protective layer may further be provided if desired.

In connection to the layer structure, binder, additive, location of the mordant-containing layer and so forth of the dye-fixing element, those described in Japanese Patent Aplication (OPI) No. 147244/86 can be applied to the present invention.

In the dye-fixing element of the present invention, as well as the above described layers, auxiliary layers such as a peeling layer, matting agent layer, and a curl preventing layer can be provided, if desired.

In one or more of the above layers may be incorporated a base and/or a base precursor and a hydrophilic heat solvent to accelerate dye transfer, an antifading agent to prevent the fading of dye, a ultraviolet ray absorber, a lubricating agent, a matting agent, an antioxidant, a dispersed vinyl compound to increase dimensional stability, a fluorescent whitening agent and the like. Typical examples of the above additives are described in Japanese Patent Application (OPI) No. 88256/86.

The binder for use in the above layers is preferably hydrophilic. A typical example of such binders is a transparent or translucent hydrophilic colloid. More specifically the binders as described above for the light-sensitive element can be used.

In coating layers such as a heat-developable light-sensitive layer, a protective layer, an intermediate layer, a subbing layer and a backing layer, the methods described in U.S. Pat. No. 4,500,626 can be applied.

As a light source for imagewise exposure to record an image on the heat-deelopable light-sensitive element of the present ivention, radiations including visible light can be employed. For example, the light sources described in Japanese Patent Application (OPI) No. 147244/86, and U.S. Pat. No. 4,500,626 can be used.

In order to accelerate dye transfer, a hydrophilic heat solvent which is solid at ordinary temperature but is liquified at elevated temperatures may be incorporated in the light-sensitive element o the dye fixing element of the present invention. The hydrophilic heat solvent may be incorporated in any one of the light-sensitive and dye fixing elements or both of the elements. The hydrophilic heat solvent may be incorporated in any of an emulsion layer, an intermediate layer, a protective layer, and a dye fixing layer. It is preferred for the hydrophilic heat solvent to be incorporated in the dye fixing layer and/or its adjacent layer.

Examples of such hydrophilic heat solvents include ureas, pyridines, amides, sulfonamides, imides, alcohols, oximes, and other heterocyclic rings.

The present invention is described in greater detail with reference to the followng examples, but not limited thereto.

EXAMPLE 1

5 ml of a 5% aqueous solution of sodium dodecylbenzene sulfonate was added to 100 g of a 10% aqueous gelatin solution. In addition, 20 g of Compound (1) was added. The resulting mixture was emulsified and dispersed for 6 minutes at 10,000 rpm by the use of a homoblender, to prepare Oil Droplet Dispersion (Y-1).

Using the above prepared Oil Droplet Dispersion (Y-1), Dye Fixing Element (R-1) having the construction shown in Table 1 was prepared.

TABLE 1

| | Composition | Coated amount ($g/m^2$) |
|---|---|---|
| Second Layer: | | |
| Protective Layer | Gelatin | 0.7 |
| | Hardener H | 0.25 |
| | Surface active agent A | 0.2 |
| | Surface active agent B | 0.04 |
| First Layer: | | |
| Dye Fixing Layer | Gelatin | 1.4 |
| | Dextran (molecular weight about 70,000) | 0.7 |
| | Mordant M-1 | 2.3 |
| | Oil Droplet Dispersion (Y-1) | 2.8 |
| | Guanidium picolate | 2.3 |

Polyethylene laminated paper support

Hardener H

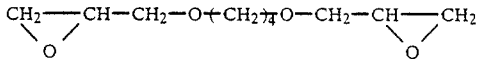

Surface active agent A

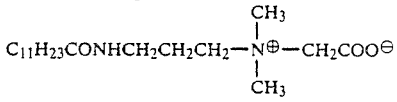

Surface active agent B

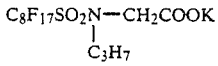

Mordant M-1

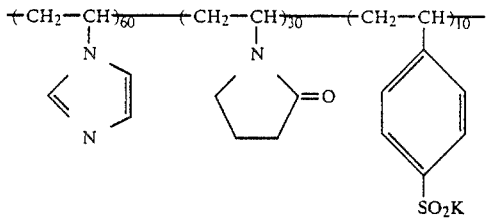

Dye Fixing Element R-2 to R-5 were prepared in the same manner as in the preparation of Dye Fixing Material R-1 except that the amount of Oil Droplet Dispersion (Y-1) added (i.e., the amount of Compound (1) coated), was changed as shown in Table 2.

Oil Droplet Dispersions (Y-2) to (Y-9) were prepared in the same manner as in the preparation of Oil Droplet Dispersion (Y-1), except that Compound (1) was replaced with the compounds shown in Table 2.

Dye Fixing Element R-6 to R-13 were prepared in the same manner as in the preparation of Dye Fixing Material R-1 except that the above Oil Droplet Dispersions (Y-2) to (Y-9) were used. The amount of each compound coated is shown in Table 2.

Dye Fixing Element R-14 was prepared in the same manner as in the preparation of Dye Fixing Material R-1, except that the oil droplets were excluded.

Dye Fixing Element R-1 to R-14 were measured for the brittleness of the coating and the gloss of the coating surface. The results are shown in Table 2.

TABLE 2

| Dye-Fixing Element | Oil Droplet Dispersion: Dispersion | Compound | Amount of Compound coated (Content)*1 (g/m²) | (Organic/Inorganic) value | Brittleness*2 (mm) | Gloss*3 |
|---|---|---|---|---|---|---|
| R-1 | Y-1 | (1) | 2.8 (70 vol %) | ∞ | 8 | B |
| R-2 | Y-1 | (1) | 2.2 (60 vol %) | ∞ | 8 | A |
| R-3 | Y-1 | (1) | 1.4 (35 vol %) | ∞ | 9 | A |
| R-4 | Y-1 | (1) | 0.5 (13 vol %) | ∞ | 10 | A |
| R-5 | Y-1 | (1) | 0.3 (6 vol %) | ∞ | 15 | A |
| R-6 | Y-2 | (28) | 1.4 | 8 | 8 | A-B |
| R-7 | Y-3 | (6) | 1.4 | 6.8 | 8 | A-B |
| R-8 | Y-4 | (3) | 1.4 | 4.8 | 8 | B |
| R-9 | Y-5 | (25) | 1.4 | 4.4 | 8 | B |
| R-10 | Y-6 | (31) | 1.4 | 2.6 | 9 | B-C |
| R-11 | Y-7 | (31) | 1.4 | 1.7 | 9 | C |
| R-12 | Y-8 | (40) | 1.4 | 1.5 | 8 | C |
| R-13 | Y-9 | (22) | 0.7 | 6.4 | 8 | A |
| | | (1) | 0.7 | ∞ | | |
| R-14 | Y-10 | — | — | — | 30 | A |

*1The content in the parenthesis indicates a ratio (vol %) of the total of oil droplets (Compound) to the total volume of all polymers in the added layer.

*2In the evaluation of brittleness, the Dye Fixing Element was controlled in humidity by placing in a thermostat at 25° C. and 25% RH for 2 hours, and then was bent in such a manner that the coated surface was exposed outside, and a radius of curvature at which cracking occurred was indicated (mm).

*3The rating for evaluation of gloss was as follows: A: Gloss is substantially equal to that of Dye Fixing Element R-14; B: Gloss is somewhat lower than that of Dye Fixing Element R-14; and C: Gloss is much lower than that of Dye Fixing Element R-14.

Note:

Dye Fixing Element R-14 is a comparative sample, and others are the samples according to the present invention.

As can be seen from the results of Table 2, the dye fixing element with oil droplets incorporated in the dye fixing layer thereof is greatly improved in anti-cracking property. When the (organic/inorganic) value of the compound constituting the oil droplets is greater, the gloss of the surfce of the dye fixing element is higher. When the oil droplet content is more than 5 vol %, the brittle improving effect is great. The improvement is particularly natable when the oil droplet content is more than 10 vol %. When the oil droplet content is less than 60 vol %, the gloss is excellent.

EXAMPLE 2

Dye Fixing Element R-21, R-22 and R 23 having the construction shown in Table 3, were prepared and tested in the same manner as in Example 1. The results are shown in Table 3. All the amounts of the compound added shown in Table 3 are indicated in terms of g/m².

TABLE 3

| Layer | Compound added | Dye Fixing Element R-21 | R-22 | R-23 |
|---|---|---|---|---|
| Protective Layer | Gelatin | 0.7 | 0.7 | 0.7 |
| | Oil droplet (compound (1)) | 0.25 | 0.2 | — |
| | Hardener H | 0.25 | 0.25 | 0.16 |
| | Surface active agent A | 0.2 | 0.2 | 0.2 |
| | Surface active agent B | 0.04 | 0.04 | 0.04 |
| Dye-Fixing Layer | Gelatin | 1.4 | 1.4 | 1.4 |
| | Dextran (molecular weight: about 70,000) | 0.7 | 0.7 | 0.7 |
| | Mordant M-1 | 2.3 | 2.3 | 2.3 |
| | Oil droplet (Compound (1)) | — | 1.4 | 1.4 |
| | Guanidium picolate | 1.8 | 1.8 | 1.8 |
| Subbing Layer | Gelatin | 0.7 | 0.7 | 0.7 |
| | Hardener H | 0.12 | 0.12 | 0.12 |
| | Oil droplet (Compound (1)) | — | — | 1.2 |
| | Guanidium picolate | 0.5 | 0.5 | 0.5 |
| Brittleness (mm) | | 28 | 8 | 8 |
| Gloss | | B | A-B | A |

In Table 3, the hardener, the surface active agents and the mordant used, and the evaluations of brittleness and gloss are the same as in Example 1.

It can be seen from the results of Table 3 that when the oil droplets are added to layers other than the uppermost layer, both the brittleness and gloss are satisfied.

EXAMPLE 3

Preparation of Silver Benzotriazole Emulsion 28 g of gelatin and 13.2 g of benzotriazole were dissolved in 300 ml of water. The resulting solution was stirred while maintaining at 40° C. A solution of 17 g of silver nitrate in 100 ml of water added to the above solution over 2 minutes.

The emulsion obtained was adjusted in pH, precipitated and freed of an excess of salts. Then the pH was adjusted to 6.30, and Silver Benzotriazole Emulsion was obtained in a yield of 400 g.

Preparation of Silver Acetylene Emulsion 28 g of gelatin and 26.7 g of potassium 4-acetylaminophenylpropionate were dissolved in 500 ml of water. The resulting solution was stirred while maintaining it at 40° C. A solution of 17 g of silver nitrate in 100 ml of water was added to the above solution over 2 minutes and then the resulting solution was further stirred for 10 minutes.

This emulsion was adjusted to pH 6.30 and then subjected to centrifugal separation to obtain Silver Acetylene Emulsion in a yield of 400 g.

Preparation of Silver Halide Emulsion for Fifth and First Layers 600 ml of an aqueous solution containing sodium chloride and potassium bromide and an aqueous solution of silver nitrate (prepared by dissolving 0.59 mol of silver nitrate in 600 ml of water) were added at the same time to an aqueous gelatin solution (containing 20 g of gelatin and 3 g of sodium chloride in 1,000 ml of water, and maintained at 75° C.) which was being well stirred, over 40 minutes at the same flow rate. In this way, a monodisperse cubic silver chlorobromide emulsion (bromide content: 50 mol %) having an average particle size of 0.40 micrometer was prepared.

After washing with water and desalting, 5 mg of sodium thiosulfate and 20 mg of 4-hydroxy-6-methyl-1,3,3a,7-tetrazaindene were added, and chemical sensitization was conducted at 60° C. The yield of the emulsion was 600 g.

Preparation of Silver Halide Emulsion for Third Layer 600 ml of an aqueous solution containing sodium chloride and potassium bromide and an aqueous silver nitrate solution (prepared by dissolving 0.59 mol of silver nitrate in 600 ml of water) were added at the same time to a vigorously-stirred aqueous solution of gelatin (containing 20 g of gelatin and 3 g of sodium chloride in 1,000 ml of water maintained at 75° C.) over 40 minutes at a cpnstant flow rate. In this way, a monodisperse cubic silver chlorobromide emulsion (bromide content: 80 mol %) having an average particle size of 0.35 micrometer was prepared.

After washing with water and desalting, 5 mg of sodium thiosulfate and 20 mg of 4-hydroxy-6-methyl-1,3,3a,7-tetrazaindene were added, and chemical sensitization was performed at 60° C. The yield of the emulsion was 600 g.

Preparation of Gelatin Dispersion of Dye Providing Substance 5 g of a yellow dye providing substance (A), and 0.5 g of sodium succinic acid-2-ethyl-hexylestersulfonate and 5 g of triisononyl phosphate as surface active agents were dissolved in 30 ml of ethyl acetate by heating at about 60° C. to prepare a uniform solution. This solution and 30 g of a 10% solution of lime-treated gelatin were mixed and stirred, and then dispersed for 10 minutes at 10,000 rpm by the use of a homogenizer. The dispersion thus prepared was designated as Dispersion of Yellow Dye Providing Substance.

Dispersion of Magenta Dye Providing Substance was prepared in the same manner as above except that a magenta dye providing substance (B) was used, and 3.75 g of tricresyl phosphate as a high boiling point solvent was used.

Dispersion of Cyan Dye Providing Substance was also prepared in the same manner as the former case above, except that a cyan dye providing substance (C) was used.

Using the above dispersions of dye providing substance, a multi-layer structure color light-sensitive element having the following construction was prepared.

| | |
|---|---|
| Seventh Layer | |
| Gelatin | 300 mg/m$^2$ |
| Hardener*3 | 10 mg/m$^2$ |
| Silica*5 | 100 mg/m$^2$ |
| Sixth Layer | |
| Gelatin | 560 mg/m$^2$ |
| Hardener*3 | 16 mg/m$^2$ |
| Reducing agent (E) | 200 mg/m$^2$ |
| Fifth Layer: Green-sensitive emulsion layer | |
| Silver chlorobromide emulsion (bromide: 50%) | 400 mg/m$^2$ (as silver) |
| Silver Acetylene Emulsion | 100 mg/m$^2$ (as silver) |
| Sensitizing Dye D-1 | $10^{-6}$ mol/m$^2$ |
| Hardener*3 | 16 mg/m$^2$ |
| Yellow Dye Providing Substance (A) | 400 mg/m$^2$ |
| Gelatin | 700 mg/m$^2$ |
| High boiling point solvent*4 | 400 mg/m$^2$ |
| Surface active agent*2 | 100 mg/m$^2$ |
| Fourth Layer: Intermediate layer | |
| Gelatin | 900 mg/m$^2$ |
| Hardener*3 | 18 mg/m$^2$ |
| Zinc hydroxide*6 | 500 mg/m$^2$ |
| Third Layer: Red-sensitive emulsion layer | |
| Silver chlorobromide emulsion (bromide: 80 mol %) | 300 mg/m$^2$ (as silver) |

-continued

| | |
|---|---|
| Sensitizing Dye D-2 | $8 \times 10^{-7}$ mol/m$^2$ |
| Hardener*3 | 18 mg/m$^2$ |
| Magenta Dye Providing Substance (B) | 400 mg/m$^2$ |
| Gelatin | 600 mg/m$^2$ |
| High boiling point solvent*1 | 300 mg/m$^2$ |
| Surface active agent*2 | 100 mg/m$^2$ |
| Second layer: Intermediate layer | |
| Gelatin | 800 mg/m$^2$ |
| Hardener*3 | 16 mg/m$^2$ |
| Zinc hydroxide*6 | 500 mg/m$^2$ |
| First Layer: Infrared light-sensitive emulsion layer | |
| Silver chlorobromide emulsion (bromide: 50 mol %) | 300 mg/m$^2$ (as silver) |
| Silver Benzotriazole Emulsion | 100 mg/m$^2$ (as silver) |
| Sensitizing Dye D-3 | $10^{-8}$ mol/m$^2$ |
| Hardener*3 | 16 mg/m$^2$ |
| Cyan Dye Providing Substance (C) | 300 mg/m$^2$ |
| Gelatin | 600 mg/m$^2$ |
| High boiling solvent*4 | 300 mg/m$^2$ |
| Surface active agent*2 | 100 mg/m$^2$ |
| Support | |
| Polyethylene terephthalate (thickness: 100 micrometers) | |

*1Tricresyl phosphate

*2 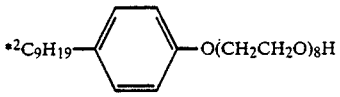

*31,2-Bis(vinylsulfonylacetamido)ethane
*4(iso $C_9H_{19}O)_3P{=}O$
*5Size: 3 to 5 micrometers
*6Size: 0.2 to 0.3 micrometer Dye Providing Substance (A)

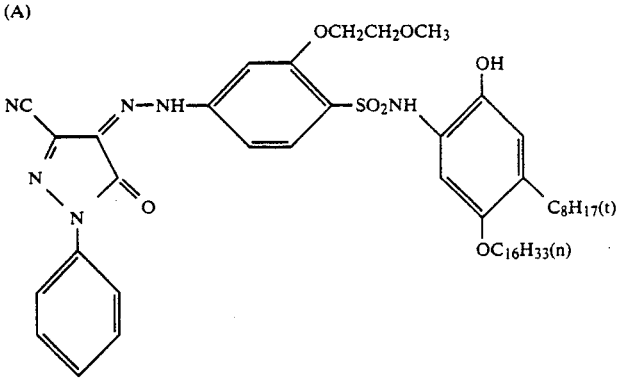

(B)

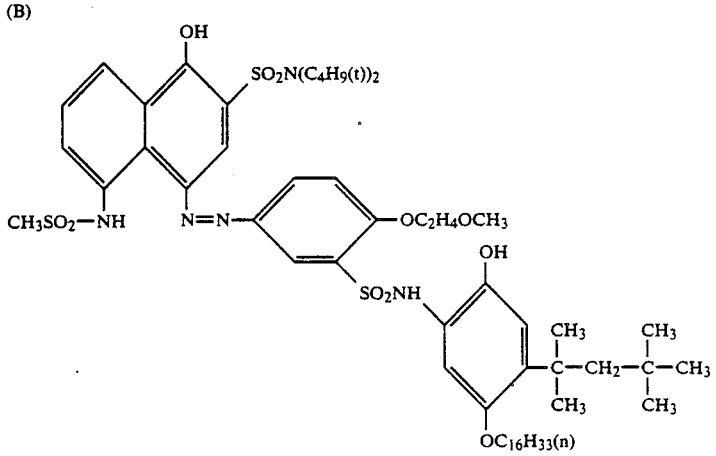

(C)

-continued
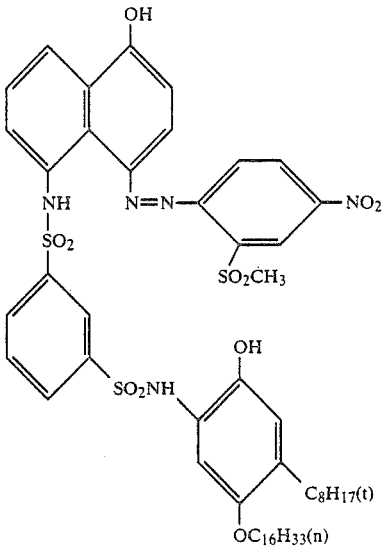
Sensitizing Dye
(D-1)
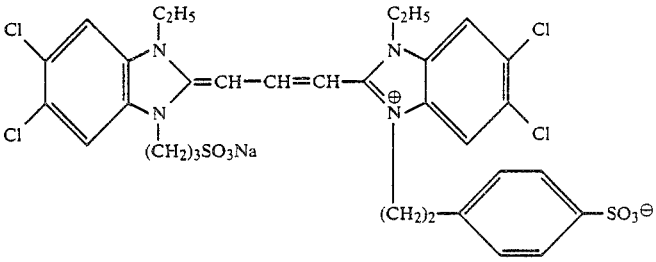
(D-2)
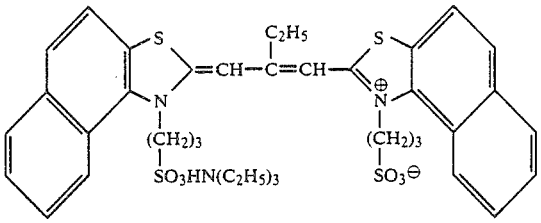
(D-3)
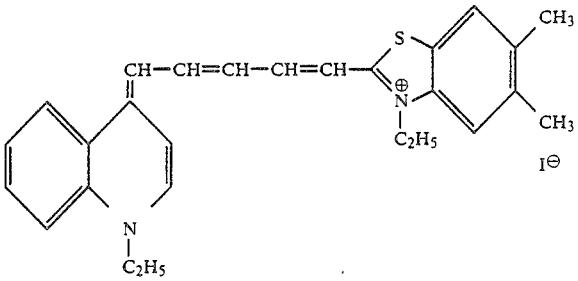
Reducing agent
(E)

-continued

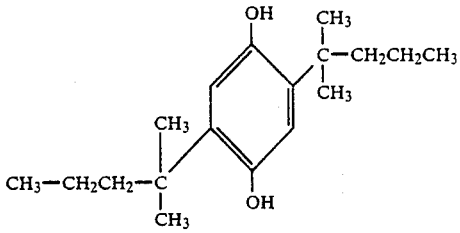

The above multi-layer structure color light-sensitive element was exposed for $10^{-4}$ second by the use of a xenon flash lamp. This exposure was performed through a G, R, IR three color separation filter in which the density changes continuously.

The emulsion surface of the above exposed light-sensitive element was coated with 11 ml/m$^2$ of water by the use of a wire bar. Then, Dye Fixing Elements R-3, R-13 and R-14 were each superposed on the light-sensitive material in such a manner that the coatings were in contact with each other. The assembly was heated for 35 seconds by the use of a heat roller controlled in temperature so that the temperature of the water absorbed coating reached 93° C. Then the light-sensitive element was peeled apart from the dye fixing element, whereupon sharp images of yellow, magenta and cyan were formed on the dye fixing element, corresponding to the G, R, IR three color separation filter.

The maximum density (Dmax) and the minimum density (Dmin) of each color were measured by the use of a Macbeth reflective densitometer (Model RD-519). The results are shown in Table 4.

The above processed dye fixing elements were measured for an extent of cracking in the same manner as in Example 1. The results are shown in Table 4.

TABLE 4

| Dye Fixing Element | Oil Droplets | Brittleness (mm) | Dmax | | | Dmin | | |
|---|---|---|---|---|---|---|---|---|
| | | | Y | M | C | Y | M | C |
| R-3 | present | 7 | 1.95 | 2.27 | 2.40 | 0.18 | 0.16 | 0.19 |
| R-4 | present | 8 | 1.92 | 2.22 | 2.38 | 0.20 | 0.21 | 0.18 |
| R-5 | absent | ≧30 | 1.39 | 2.20 | 2.35 | 0.28 | 0.25 | 0.24 |

It can be seen from the results of Table 4 that if the oil droplets are added, the cracking is improved without decreasing Dmax, and further Dmin can be desirebly decreased.

EXAMPLE 4

Preparation of Dye Fixing Element

Dye Fixing Element R-41 having the structure shown below on a paper support laminated with polyethylene was prepared.

| | | |
|---|---|---|
| Second Layer | Gelatin | 0.7 g/m$^2$ |
| | Hardener H | 0.24 g/m$^2$ |
| First Layer | Gelatin | 1.4 g/m$^2$ |
| | Mordant*2 | 2.6 g/m$^2$ |
| | Guanidium picolate | 2.5 g/m$^2$ |

-continued

Support (thickness: 120 micrometers)

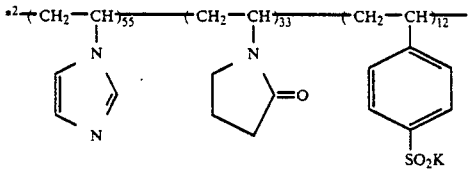

The multi-layer structure color light-sensitive element used in Example 3 was exposed for 1 second at 500 lux through a G, R, IR three color separation filter having continuously changing densities (composed of band pass filters of 500 to 600 nm for G and 600 to 700 nm for R, and a filter passing more than 700 nm for IR) by the use of a tungusten lamp.

7 ml/m$^2$ of water was applied to the emulsion surface of the above exposed light-sensitive element by the use of a wire bar, and then the light-sensitive element was superposed on Dye Fixing Element R-41 in such a manner that the coatings were in contact with each other.

The assembly was heated for 20 seconds by the use of a heat roller so that the temperature of the water-contained coating reached 90° to 95° C. Then the dye fixing element was peeled apart from the light-sensitive element and measured for brittleness and photographic characteristics. The results are shown in Table 5.

Dye Fixing Element R-42 was prepared in the same manner as in the preparation of Dye Fixing Element R-41, except that additionally 0.15 g/m$^2$ of Polymer Latex (P-5) was added to the first layer of Dye Fixing Element R-41.

Dye Fixing Element R-43 was prepared in the same manner as in the preparation of Dye Fixing Element R-41, except that additionally 0.8 g/m$^2$ of Polymer Latex (P-5) was added to the second layer of Dye Fixing Element R-41.

Dye Fixing Elements R-41 to R-43 were measured for brittleness and photographic characteristics in the same manner as in Example 1. The results are shown in Table 5.

TABLE 5

| Dye-Fixing Element | Brittleness (mm) | Maximum Density | | |
|---|---|---|---|---|
| | | Yellow | Magenta | Cyan |
| R-41 | 22 | 2.11 | 2.35 | 2.47 |
| R-42 | 10 | 2.09 | 2.36 | 2.47 |
| R-43 | 9.4 | 2.15 | 2.38 | 2.47 |

Note:
Dye Fixing Element R-41 is a comparative sample, and others are samples according to the present invention.

It can be seen from the results shown in Table 5 that the dye fixing element according to the present invention is much more improved in brittleness over the conventional dye fixing element. When the dye fixing element of the present was handled in the usual manner, no cracking occurred and a good quality image was obtained.

EXAMPLE 5

Oil Droplet Dispersion (Y-11) was prepared in the same manner as in the preparation of Oil Droplet Dispersion (Y-1) in Example 1 except that Compound (1) was replaced with Compound (21).

Using Oil Droplet Dispersions (Y-1) and (Y-11) and Polymer Latex (P-5) shown in Table 6, Dye Fixing Elements R-51 to R-58 were prepared.

The brittleness of a coating and the gloss of the surface of the coating of these elements were measured in the same manner as in Example 1. The results are also shown in Table 6.

In all Dye Fixing Elements in Table 6, the protective layer contained 0.15 g/m$^2$ of the surface active agent A, 0.03 g/m$^2$ of the surface active agent B and 0.25 g/m$^2$ of Hardener H, and the mordanting layer contained 0.07 g/m$^2$ of the surface active agent A and 0.015 g/m$^2$ of the surface active agent B. As the support for these dye fixing elements, a paper support laminated with polyethylene was used, having a polyethylene thickness of 30 $\mu$m and a basis weight of the paper of 85 g/m$^2$.

The brittleness of the dye fixing elements was evaluated in the same manner as in Example 1.

The gloss of the elements was evaluated as follows.

A: Equal to the gloss of Dye Fixing element R-51 not containing any oil droplet dispersion.

B: Somewhat lower than that of Dye Fixing Element R-51.

C: Much lower than that of Dye Fixing Element R-51.

TABLE 6

| Construction | Dye Fixing Element | | | | | | | |
|---|---|---|---|---|---|---|---|---|
| | R-51 | R-52 | R-53 | R-54 | R-55 | R-56 | R-57 | R-58 |
| Protective Layer | | | | | | | | |
| Gelatin (g/m$^2$) | 0.7 | 0.7 | 0.7 | 0.7 | 0.7 | 0.7 | 0.7 | 0.7 |
| Latex (P-5) (Amount of Polymer Component) (g/m$^2$) | — | — | 0.2 | — | 0.2 | 0.2 | 0.2 | 0.2 |
| Oil Droplets (Amount of Oil Component) (g/m$^2$) | — | (Y-1) 0.2 | — | (Y-1) 0.2 | — | — | — | — |
| Mordanting Layer | | | | | | | | |
| Gelatin (g/m$^2$) | 1.4 | 1.4 | 1.4 | 1.4 | 1.4 | 1.4 | 1.4 | 1.4 |
| Dextran (MW: 70,000) (g/m$^2$) | 0.7 | 0.7 | 0.7 | 0.7 | 0.7 | 0.7 | 0.7 | 0.7 |
| Mordant M-1 (g/m$^2$) | 2.6 | 2.6 | 2.6 | 2.6 | 2.6 | 2.6 | 2.6 | 2.6 |
| Latex (P-5) (Amount of Polymer Component) (g/m$^2$) | — | — | 1.4 | 1.4 | — | — | — | — |
| Oil Droplets (Amount of Oil Component) (g/m$^2$) | — | (Y-1) 1.4 | — | — | (Y-1) 1.4 | (Y-11) 1.4 | (Y-1) 1.4 | (Y-1) 1.4 |
| Guanidium Picolate (g/m$^2$) | 2.4 | 2.4 | 2.4 | 2.4 | 2.4 | 2.4 | 2.4 | 1.4 |
| Subbing Layer | | | | | | | | |
| Gelatin (g/m$^2$) | — | — | — | — | — | — | — | 1.0 |
| Hardener H (g/m$^2$) | — | — | — | — | — | — | — | 0.1 |
| Oil droplets (g/m$^2$) | — | — | — | — | — | — | — | (Y-1) 0.3 |
| Guanidium picolate (g/m$^2$) | — | — | — | — | — | — | — | 1.0 |
| Brittleness (mm) | 35 | 7 | 12 | 11 | 3 | 4 | 4 | 3 |
| Gloss | A | B–C | C | C | A | A | A | A |

It can be seen from the results shown in Table 6 that the samples according to the present invention using oil droplets and a latex in combination are excellent in brittleness improving effect. Further, it can be seen that by adding the oil droplets to the hydrophilic colloid layer other than the uppermost layer, and adding the latex to the hydrophilic colloid layer positioned on or above the mordant layer, the optimum results are obtained in brittleness and gloss.

EXAMPLE 6

The multi-layer structure color light-sensitive element in Example 3 was exposed for $10^{-4}$ second by the use of a xenon flash tube. This exposure was conducted through a G (green), R (red), and IR (infrared) three color separation filter having continuously changing densities.

11 ml/m$^2$ of water was applied to the emulsion surface of the above exposed light-sensitive material by the use of a wire bar. Then Dye Fixing Elements R-51, R-52, R-53 and R-55 were each superposed on the light-sensitive material in such a manner that the coatings were in contact with each other. The assembly was heated for 35 seconds by the use of a heat roller, the temperature of which was controlled so that the temperature of the water-contained coating reached 93° C. Then the light-sensitive element was peeled apart from the dye fixing element, whereupon sharp yellow, magneta, and cyan images corresponding to the G, R, IR three color separation filter were formed on the dye fixing element.

Each color was measured for the maximum density (Dmax) and the minimum density (Dmin) by the use of a Macbeth reflective densitometer (Model RD-519). The results are shown in Table 7.

The extent of cracking (brittleness) of the dye fixing element after the above processing was measured in the same manner as in Example 5. The results are shown in Table 7.

TABLE 7

| Dye fixing Element | Remarks | Brittleness (mm) | Dmax Y | Dmax M | Dmax C | Dmin Y | Dmin M | Dmin C |
|---|---|---|---|---|---|---|---|---|
| R-51 | | 32 | 1.96 | 2.13 | 2.23 | 0.24 | 0.22 | 0.20 |
| R-52 | oil droplets | 8 | 1.84 | 2.01 | 2.12 | 0.17 | 0.18 | 0.16 |
| R-53 | latex | 13 | 1.81 | 1.98 | 2.08 | 0.23 | 0.22 | 0.18 |
| R-55 | oil droplets and latex | 3 | 2.02 | 2.12 | 2.28 | 0.18 | 0.17 | 0.16 |

It can be seen from the results shown in Table 7 that by using the oil droplets and the latex in combination, higher Dmax and lower Dmin are obtained in comparison to the case where the oil droplets or the latex is used singly.

While the invention has been described in detail and with reference to specific examples thereof, it will be apparent to one skilled in the art that various changes and modifications can be made therein without departing from the spirit and scope thereof.

What is claimed is:

1. A method for forming an image which comprises heating, in the presence of water, a combination of (i) a light-sensitive element having been exposed to light comprising a support having provided thereon at least one layer containing a light-sensitive silver halide, a binder, a dye providing substance, and a slightly water soluble metal compound capable of generating a base upon reacting with a complex-forming compound in the presence of water; and (ii) a dye fixing element comprising a mordant capable of fixing a mobile dye formed in said light-sensitive element and said complex-forming compound capable of undergoing a complex-forming reaction with a metal ion of said slightly water soluble metal compound, wherein said dye fixing element further contains oil droplets and a latex comprising a polymer having a glass transition point of 40° C. or less, provided that said oil droplets are present in at least one hydrophilic colloid layer other than the uppermost layer of said dye fixing element and said latex is present in a hydrophilic colloid layer positioned on or above a layer containing said mordant.

2. A method for forming an image as in claim 1, wherein said dye fixing element comprises at least two hydrophilic colloid layers in which one of said hydrophilic colloid layers is a mordanting layer containing a mordant.

3. A method for forming an image as in claim 1, wherein said oil droplets have an average particle diameter of not more than 3 micrometers.

4. A method for forming an image as in claim 3, wherein said oil droplets have an average particle diameter of not more than 1 micrometer.

5. A method for forming an image as in claim 4, wherein said oil droplets have an average particle diameter of not more than 0.5 micrometer.

6. A method for forming an image as in claim 1, wherein the amount of said oil droplets is in the range of from 5 to 60 vol % based on the total amount of the polymer components in the layer to which said oil droplets are added.

7. A method for forming an image as in claim 6, wherein the amount of said oil droplets is in the range of from 10 to 50 vol % based on the total amount of the polymer components in the layer to which said oil droplets are added.

8. A method for forming an image as in claim 7, wherein the amount of said oil droplets is in the range of from 20 to 40 vol % based on the total amount of the polymer components in the layer to which said oil droplets are added.

9. A method for forming an image as in claim 1, wherein said oil droplets comprise a substituted or unsubstituted saturated or unsaturated hydrocarbon compound containing at least 10 carbon atoms or a compound represented by formula (A), (B), (C), (D), (E), (F), or (G)

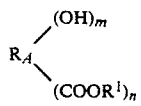

(A)

wherein $R_A$ represents a substituted or unsubstituted aliphatic hydrocarbon group having a valency of m+n, $R^1$ represents a substituted or unsubstituted aliphatic, alicyclic, or aromatic hydrocarbon group, and m and n each represent an integer of from 1 to 5;

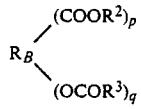

(B)

wherein $R_B$ represents a substituted or unsubstituted aliphatic or alicyclic hydrocarbon group having a valency of p+q; $R^2$ and $R^3$ each represents a substituted or unsubstituted aliphatic or alicyclic hydrocarbon group; p represents 0, 1, 2, or 3; and q represents 0, 1, 2, or 3, provided that p+q represents 1 or more;

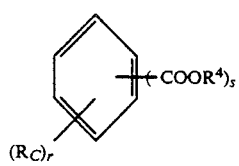

(C)

wherein $R_C$ represents a hydrogen atom, or a substituted or unsubstituted aliphatic hydrocarbon, alicyclic hydrocarbon, aromatic hydrocarbon, acyl, amino, acyloxy, carbamoyl, ureido, alkoxycarbonyl, aryloxycarbonyl, or cycloalkyloxycarbonyl group, or a halogen atom, a hydroxyl group, a carboxyl group, a nitro group, or a cyano group; $R^4$ represents a substituted or unsubstituted aliphatic, alicyclic, or aromatic hydrocarbon group; r represents an integer of from 1 to 5; s represents an integer of from 1 to 4, provided that r+s represents an integer of 6 or less; when r is 2 or more, the $R_C$ groups are the same or different, and when s is 2 or more, the $R^4$ groups are the same or different;

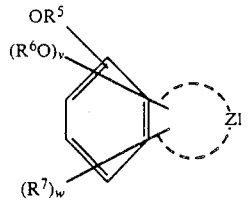

(D)

wherein $R^5$ and $R^6$ each represent a substituted or unsubstituted alkyl, monocyclic or polycyclic alicyclic hydrocarbon, aryl, or aralkyl group; $R^7$ represents a substituted or unsubstituted alkyl, aryl, aralkyl, or amino group, or a halogen atom; Z represents an atomic group forming a carbon ring condensed with the benzene ring; l represents 0 or 1; v represents an integer of from 0 to 2; and w represents an integer of from 0 to 7, provided that v+w represent an integer of 7 or less, in which at least one of $R^6O$ and $R^7$ is substituted in at least one of the benzene ring and a carbocyclic ring condensed with the benzene ring;

$$(R^8-O)_3P=O \quad (E)$$

wherein each $R^8$ represents a substituted or unsubstituted alkyl, cycloalkyl, alkenyl, or aryl group;

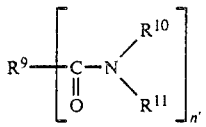

(F)

wherein $R^9$ represents a hydrogen atom, or a substituted or unsubstituted aliphatic hydrocarbon group having a valency of n'; $R^{10}$ and $R^{11}$ are the same or different and each represent a hydrogen atom, or a substituted or unsubstituted aliphatic or aromatic hydrocarbon group; and n' represents 1 or 2, or $R^9$ and $R^{10}$, and $R^{10}$ and $R^{11}$ together form a heterocyclic ring $$R_G-COO-R^{12} \quad (G)$$

wherein $R_G$ represents a substituted or unsubstituted aliphatic hydrocarbon group; and $R^{12}$ represents a substituted or unsubstituted aliphatic, alicyclic, or aromatic hydrocarbon group.

10. A method for forming an image as in claim 9, wherein said oil droplets comprise a saturated hydrocarbon compound which is partially or wholly substituted with a chlorine atom, or a phosphate type high boiling point organic solvent represented by formula (E)

$$(R^8-O)_3P=O \quad (E)$$

wherein each $R^8$ represents a substituted or unsubstituted alkyl, cycloalkyl, alkenyl, or aryl group.

11. A method for forming an image as in claim 1, wherein said latex comprising a polymer having a glass transition point of 40° C. or less is a latex of a polymer of an acrylic acid ester, a latex of a copolymer of an acrylic acid ester and a methacrylic acid ester, or a latex of a copolymer of an acrylic acid ester and an acrylic or methacrylic acid.

12. A method for forming an image as in claim 1, wherein said latex comprises a polymer having a glass transition point of 20° C. or less.

13. A method for forming an image as in claim 2, wherein the amount of the polymer contained in said latex is in the range of from 5 to 200 vol % based on the total amount of the hydrophilic binder contained in the layer to which said latex is added.

14. A method for forming an image as in claim 13, wherein the amount of the polymer contained in said latex is in the, range of from 10 to 100 vol % based on the total amount of the hydrophilic binder contained in the layer to which said latex is added.

15. A method for forming an image as in claim 1; wherein the coated amount of the polymer contained in said latex is in the range of from 1 $mg/m^2$ to 5 $g/m^2$.

16. A method for forming an image as in claim 15, wherein the coated amount of the polymer contained in said latex is in the range of from 10 $mg/m^2$ to 2 $g/m^2$.

17. A method for forming an image as in claim 1, wherein said latex is contained in a layer adjacent to the mordanting layer containing said mordant.

18. A method for forming an image as in claim 1, wherein said mordant is a polymer containing a vinyl monomer unit represented by formula (I)

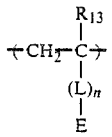

(I)

wherein $R_{13}$ represents a hydrogen atom or a lower alkyl group having from 1 to 6 carbon atoms; L represents a divalent linking group having from 1 to about 20 carbon atoms; E represents an imidazole ring; and n represents 0 or 1.

19. A method for forming an image as in claim 1, wherein a layer containing said latex is provided above a layer containing said oil droplets.

20. A method for forming an image as in claim 1, wherein said slightly water soluble metal compound is selected from the group consisting of zinc carbonate, zinc hydroxide, zinc oxide, aluminum carbonate, aluminum hydroxide, aluminum oxide, calcium carbonate, calcium hydroxide, calcium oxide, barium carbonate, barium hydroxide and barium oxide.

21. A method for forming an image as in claim 1, wherein said complex-forming compound is a salt of a compound selected from the group consisting of aminocarboxylic acids, iminodiacetic acids, pyridylcarboxylic acids, aminophosphoric acids, carboxylic acids, hydroxamic acids, polyacrylates, polyphosphoric acids, alkali metals, guanidines, amidines, and quaternary ammonium compounds.

22. A method for forming an image as in claim 1, wherein the molar ratio of the complex-forming compound to the slightly water soluble compound is in the range of from 1/100 to 100/1.

23. A method for forming an image as in claim 22, wherein said molar ratio is from 1/10 to 20/1.

24. A method for forming an image as in claim 1, wherein said slightly water soluble compound is present in an amount of up to 50 wt % on the weight of the coated layer in which it is present.

25. A method for forming an image as in claim 1, wherein said complex-forming compound is prsent in an amount of up to 50 wt % based on the weight of the coated layer in which it is present.

26. A method for forming an image as in claim 24, wherein said amount is from 0.01 to 40 wt %.

27. A method for forming an image as in claim 25, wherein said amount is from 0.01 to 40 wt %.

28. A method for forming an image which comprises heating, in the presence of water, a combination of (i) a light sensitive element having been exposed to light comprising a support having provided thereon at least one layer containing a light-sensitive silver halide, a binder, a dye providing substance, and a slightly water soluble metal compound capable of generating a base upon reacting with a complex-forming compound in the presence of water; and (ii) a dye fixing element comprising a mordant capable of fixing a mobile dye formed in said light-sensitive element and said complex forming compound capable of undergoing a complex-forming reaction with a metal ion of said slightly water soluble metal compound, wherein said dye fixing element further contains oil droplets present in at least one hydrophilic colloid layer other than the uppermost layer of said dye fixing element.

29. A method for forming an image which comprises heating, in the presence of water, a combination of (i) a light-sensitive element having been exposed to light comprising a support having provided thereon at least one layer containing a light-sensitive silver halide, a binder, a dye providing substance, and a slightly water soluble metal compound capable of generating a base upon reacting with a complex-forming compound in the presence of water; and (ii) a dye fixing element comprising a mordant capable of fixing a mobile dye formed in said light-sensitive element and said complex-forming compound capable of undergoing a complex-forming reaction with a metal ion of said slightly water soluble metal compound, wherein said dye fixing element further contains a latex comprising a polymer having a glass transition point of 40° C. or less.

30. A method for forming an image as in claim 28, wherein said oil droplets have an average particle diameter of not more than 1 micrometer.

31. A method for forming an image as in claim 28, wherein the amount of said oil droplets is in the range of from 10 to 50 vol % based on the total amount of the polymer components in the layer to which said oil droplets are added.

32. A method for forming an image as in claim 28, wherein said oil droplets comprise a substituted or unsubstituted saturated or unsaturated hydrocarbon compound containing at least 10 carbon atoms or a compound represented by formula (A), (B), (C), (D), (E), (F), or (G)

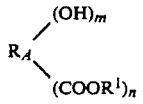

(A)

wherein $R_A$ represents a substituted or unsubstituted aliphatic hydrocarbon group having a valency of m+n, $R^1$ represents a substituted or unsubstituted aliphatic, alicyclic, or aromatic hydrocarbon group, and m and n each represent an integer of from 1 to 5;

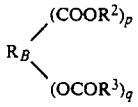

(B)

wherein $R_B$ represents a substituted or unsubstituted aliphatic or alicyclic hydrocarbon group having a valency of p+q; $R^2$ and $R^3$ each represents a substituted or unsubstituted aliphatic or alicyclic hydrocarbon group; p represents 0, 1, 2, or 3; and q represents 0, 1, 2, or 3, provided that p+q represents 1 or more;

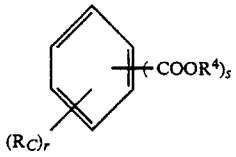

(C)

wherein $R_C$ represents a hydrogen atom, or a substituted or unsubstituted aliphatic hydrocarbon, alicyclic hydrocarbon, aromatic hydrocarbon, acyl, amino, acyloxy, carbamoyl, ureido, alkoxycarbonyl, aryloxycarbonyl, or cycloalkyloxycarbonyl group, or a halogen atom, a hydroxyl group, a carboxyl group, a nitro group, or a cyano group; $R^4$ represents a substituted or unsubstituted aliphatic, alicyclic, or aromatic hydrocarbon group, r represents an integer of from 1 to 5; s represents an integer of from 1 to 4, provided that r+s represents an integer of 6 or less, when r is 2 or more, the $R_C$ groups are the same or different, and when s is 2 or more, the $R^4$ groups are the same or different;

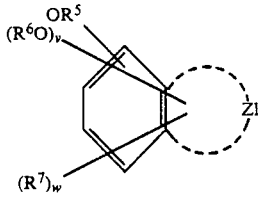

(D)

wherein $R^5$ and $R^6$ each represent a substituted or unsubstituted alkyl, monocyclic or polycyclic alicyclic hydrocarbon, aryl, or aralkyl group; $R^7$ represents a substituted or unsubstituted alkyl, aryl, aralkyl, or amino group, or a halogen atom; Z represents an atomic group forming a carbon ring condensed with the benzene ring; l represents 0 or 1; v represents an integer of from 0 to 2; and w represents an integer of from 0 to 7, provided that v+w represent an integer of 7 or less, in which at least one of $R^6O$ and $R^7$ is substituted in at least one of the benzene ring and a carbocyclic ring condensed with the benzene ring:

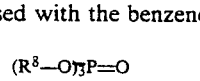

(E)

wherein each $R^8$ represents a substituted or unsubstituted alkyl, cycloalkyl, alkenyl, or aryl group;

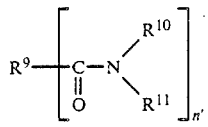

(F)

wherein $R^9$ represents a hydrogen atom, or a substituted or unsubstituted aliphatic hydrocarbon group having a valency of n'; $R^{10}$ and $R^{11}$ are the same or different and each represent a hydrogen atom, or a substituted or unsubstituted aliphatic or aromatic hydrocarbon group; and n' represents 1 or 2, or $R^9$ and $R^{10}$, and $R^{10}$ and $R^{11}$ together form a heterocyclic ring $$R_G—COO—R^{12} \quad (G)$$

wherein $R_G$ represents a substituted or unsubstituted aliphatic hydrocarbon group; and $R^{12}$ represents a substituted or unsubstituted aliphatic, alicyclic, or aromatic hydrocarbon group.

33. A method for forming an image as in claim 32, wherein said oil droplets comprise a saturated hydrocarbon compound which is particularly or wholly substituted with a chlorine atom, or a phosphate type high boiling point organic solvent represented by formula (E)

$$(R^8—O)_3P=O \quad (E)$$

wherein each $R^8$ represents a substituted or unsubstituted alkyl, cycloalkyl, alkenyl, or aryl group.

34. A method for forming an image as in claim 28, wherein said mordant is a polymer containing a vinyl monomer unit represented by formula (I)

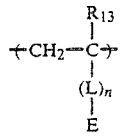

(I)

wherein $R_{13}$ represents a hydrogen atom or a lower alkyl group having from 1 to 6 carbon atoms, L represents a divalent linking group having from 1 to about 20 carbon atoms; E represents an imidazole ring; and n represents 0 or 1.

35. A method for forming an image as in claim 28, wherein said slightly water soluble metal compound is selected from the group consisting of zinc carbonate, zinc hydroxide, zinc oxide, aluminum carbonate, aluminum hydroxide, aluminum oxide, calcium carbonate, calcium hydroxide, calcium oxide, barium carbonate, barium hydroxide and barium oxide.

36. A method for forming an image as in claim 28, wherein said complex-forming compound is a salt of a compound selected from the group consisting of aminocarboxylic acids, iminodiacetic acids, pyridylcarboxylic acids, aminophosphoric acids, carboxylic acids, hydroxamic acids, polyacrylates, polyphosphoric acids, alkali metals, guanidines, amidines, and quaternary ammonium compounds.

37. A method for forming an image as in claim 28, wherein the molar ratio of the complex-forming compound to the slightly water soluble compound is in the range of from 1/100 to 100/1.

38. A method for forming an image as in claim 37, wherein said molar ratio is from 1/10 to 20/1.

39. A method for forming an image as in claim 28, wherein said slightly water soluble compound is present in an amount of up to 50 wt % based on the weight of the coated layer in which it is present.

40. A method for forming an image as in claim 28, wherein said complex-forming compound is present in an amount of up to 50 wt % based on the weight of the coated layer in which it is present.

41. A method for forming an image as in claim 29, wherein said latex comprising a polymer having a glass transition point of 40° C. or less is a latex of a polymer of an acrylic acid ester, a latex of a copolymer of an acrylic acid ester and a methacrylic acid ester, or a latex of a copolymer of an acrylic acid ester and an acrylic or methacrylic acid.

42. A method for forming an image as in claim 29, wherein said latex comprises a polymer having a glass transition point of 20° C. or less.

43. A method for forming an image as in claim 29, wherein the amount of the polymer contained in said latex is in the range of from 5 to 200 vol % based on the total amount of the hydrophilic binder contained in the layer to which said latex is added.

44. A method for forming an image as in claim 43, wherein the amount of the polymer contained in said latex is in the range of from 10 to 100 vol % based on the total amount of the hydrophilic binder contained in the layer to which said latex is added.

45. A method for forming an image as in claim 29, wherein said coated amount of the polymer contained in said latex is in the range of from 1 mg/m$^2$ to 5 g/m$^2$.

46. A method for forming an image as in claim 29, wherein said mordant is a polymer containing a vinyl monomer unit represented by formula (I)

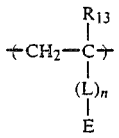

(I)

wherein $R_{13}$ represents a hydrogen atom or a lower alkyl group having from 1 to 6 carbon atoms; L represents a divalent linking group having from 1 to about 20 carbon atoms; E represents an imidazole ring; and n represents 0 to 1.

47. A method for forming an image as in claim 29, wherein said slightly water soluble metal compound is selected from the group consisting of zinc carbonate, zinc hydroxide, zinc oxide, aluminum carbonate, aluminum hydroxide, aluminum oxide, calcium carbonate, calcium hydroxide, calcium oxide, barium carbonate, barium hydroxide and barium oxide.

48. A method for forming an image as in claim 29, wherein said complex-forming compound is a salt of a compound selected from the group consisting of aminocarboxylic acids, iminodiacetic acids, pyridylcarboxylic acids, aminophosphoric acids, carboxylic acids, hydroxamic acids, polyacrylates, polyphosphoric acids, alkali metals, guanidines, amidines, and quaternary ammonium compounds.

49. A method for forming an image as in claim 29, wherein the molar ratio of the complex-forming compound to the slightly water soluble compound is in the range of from 1/100 to 100/1.

50. A method for forming an image as in claim 49, wherein said molar ratio is from 1/10 to 20/1.

51. A method for forming an image as in claim 29, wherein said slightly water soluble compound is present in an amount of up to 50 wt % based on the weight of the coated layer in which it is present.

52. A method for forming an image as in claim 29, wherein said complex-forming compound is present in an amount of up to 50 wt % based on the weight of the coated layer in which it is present.

* * * * *